US009691364B1

(12) United States Patent
McCabe

(10) Patent No.: US 9,691,364 B1
(45) Date of Patent: Jun. 27, 2017

(54) INTEGRATED PIVOT MECHANISM FOR FULCRUM TREMOLO

(71) Applicant: Geoffrey Lee McCabe, Hollywood, CA (US)

(72) Inventor: Geoffrey Lee McCabe, Hollywood, CA (US)

( * ) Notice: Subject to any disclaimer, the term of this patent is extended or adjusted under 35 U.S.C. 154(b) by 32 days.

(21) Appl. No.: 15/136,199

(22) Filed: Apr. 22, 2016

(51) Int. Cl.
*G10D 3/14* (2006.01)

(52) U.S. Cl.
CPC ..... *G10D 3/146* (2013.01)

(58) Field of Classification Search
CPC ..... G10D 3/146
See application file for complete search history.

(56) References Cited

U.S. PATENT DOCUMENTS 2,972,923 A * 2/1961 Fender ..... G10D 3/146 84/267
3,056,329 A * 10/1962 Butts ..... G10D 3/146 84/313
3,142,221 A * 7/1964 Boyd ..... G10D 3/146 84/267
3,162,083 A * 12/1964 Webster ..... G10D 3/146 84/313
3,422,509 A * 1/1969 Porter ..... G10D 3/146 84/313
3,424,049 A * 1/1969 Daniel ..... G10D 3/146 84/313
3,500,711 A * 3/1970 Fender ..... G10D 3/146 84/313
4,457,201 A * 7/1984 Storey ..... G10D 3/146 84/267
4,555,970 A * 12/1985 Rose ..... G10D 3/146 84/312 P
4,656,915 A * 4/1987 Osuga ..... G10D 3/146 84/297 R
4,686,883 A * 8/1987 Piche ..... G10D 3/146 84/297 R
4,724,737 A * 2/1988 Fender ..... G10D 3/146 84/297 R
4,763,555 A * 8/1988 Minakuchi ..... G10D 3/146 84/267
4,892,025 A * 1/1990 Steinberger ..... G10D 3/146 84/313

(Continued)

*Primary Examiner* — Robert W Horn

(57) ABSTRACT

INTEGRATED PIVOT MECHANISM FOR FULCRUM TREMOLO combines the tremolo biasing element in a pre-tensioned flat spring form to provide at least one tremolo pivot axis, transverse the direction of the strings, positioned between the tremolo base plate and the body operable to hold the base plate in initial position under normal load of the force of tension created by the strings, to increase the acoustic coupling between the base plate/bridge elements and the body to provide at least one tremolo pivot axis upon which moving the traditional tremolo arm to tilt the base plate toward or away from the nut changes the harmonic and pitch tunings to mimic the unique fulcrum tremolo effect when pivoted, and, thereby, recognize a distinct species of tremolo. In a preferred arrangement, typical feature such as spring tension, string height relative to the body and intonation, etc., are adjustable. The pivot mechanism can be alternatively used to adjust the height of the bridge elements relative to the body as well as improve acoustic coupling.

20 Claims, 7 Drawing Sheets

(56) References Cited

U.S. PATENT DOCUMENTS 4,903,568 A * 2/1990 Itoh ..... G10D 3/146 84/313
4,928,564 A * 5/1990 Borisoff ..... G10D 3/146 84/313
5,198,601 A * 3/1993 McCabe ..... G10D 3/146 84/298
5,429,028 A * 7/1995 Fisher, IV ..... G10D 3/146 84/313
5,431,079 A * 7/1995 Bunker ..... G10D 3/146 84/313
5,438,902 A * 8/1995 Baker ..... G10D 3/14 84/312 R
5,477,765 A * 12/1995 Dietzman ..... G10D 3/146 84/313
5,520,082 A * 5/1996 Armstrong ..... G10D 3/146 84/313
5,522,297 A * 6/1996 Enserink ..... G10D 3/146 84/313
5,864,074 A * 1/1999 Hill ..... G10D 3/146 84/313
5,986,191 A * 11/1999 McCabe ..... G10D 3/146 84/313
6,201,172 B1 * 3/2001 Denton ..... G10D 3/146 84/313
6,563,034 B2 * 5/2003 McCabe ..... G10D 3/146 84/298
6,686,524 B2 * 2/2004 Hirayama ..... G10D 3/146 84/291
6,797,870 B2 * 9/2004 Kang ..... G10D 3/146 84/313
6,989,483 B2 * 1/2006 Ramsay ..... G10D 3/146 84/313
7,049,504 B1 * 5/2006 Galoyan ..... G10H 3/186 84/313
7,235,730 B2 * 6/2007 Hirayama ..... G10D 3/146 84/307
7,459,619 B2 * 12/2008 Gawenda ..... G10D 3/146 84/313
7,692,079 B2 * 4/2010 Lyles ..... G10D 3/14 84/312 R
7,888,571 B2 * 2/2011 Steinberger ..... G10D 3/146 84/267
8,678,659 B2 * 3/2014 Miller ..... G10D 3/146 384/313
2004/0177741 A1 * 9/2004 Hirayama ..... G10D 3/146 84/313
2006/0005687 A1 * 1/2006 Minakuchi ..... G10D 3/146 84/313
2006/0117930 A1 * 6/2006 Folmar ..... G10D 3/146 84/313

* cited by examiner

INTEGRATED PIVOT MECHANISM FOR FULCRUM TREMOLO

GENERAL BACKGROUND OF THE INVENTION

In a stringed musical instrument, such as a guitar, the strings, placed under tension, extend unsupported between a first critical point usually formed by the nut positioned where the neck joins the head and a second critical point usually formed by a clearly defined point on the bridge positioned on the body. The strings are secured or fixed at one end on the body of the instrument to what is traditionally known as the tailpiece, strung over the bridge and extended past the nut at the transition from the neck instrument to the head, and, for conventional instruments, secured at the other end to the tuning pegs where an untensioned string is tensioned and adjusted to a tuned pitched condition, proper playing pitch for play, or, simply, tuned condition; sometimes a nut arrangement is provided for a headless or tuning peg-less design. The neck further comprises a fingerboard or fret board that a player presses the strings against to play various pitches up and down the neck; the fingerboard typically is formed with a convex radius that commonly varies between approximately 9" and 16".

The second critical point can be created as a part of a bridge or combined bridge and tailpiece structure. Traditionally, the size of the bridge element is quite small so as to create a clearly defined single point of contact between the string and the bridge element. It is between these two points that the playable string length is typically determined, sometimes referred to as the scale length or harmonic length. Adjusting the relative distance between the first and second critical points is called harmonic tuning or setting the intonation. Some bridges structures are individually adjustable, that is for each string, relative to the nut for achieving a more precise harmonic tuning. Usually this adjustment of the second critical point for harmonic tuning is carried out first and then the strings of the instrument are tuned to playing pitch. Often referred to the "initial setup", it is not uncommon that further adjustment of the harmonic tuning is necessary for a variety of reasons, for example, including changing the brand of a string where the alloy of the strings is varied or when the gauge of strings the player chooses changes as well as "setting" the string by manually pulling on the string along the scale length in order to improve elasticity in the string at first tensioning before the string can confidently relied on to hold proper playing pitch during the life of the string.

Often the typical construction of the strings, particularly for guitar and bass, includes a plain end and, on the other end, a "ball end" which being a washer-like addition is wrapped by the string itself into a larger form to enable "fixing" or securing the string on the instrument to the tailpiece element; alternatives to the "ball end" include as known to those of ordinary skill in the art as "bullet ends" formed from metal and molded around the end of the string. The tailpiece is usually provides for an opening or recess sufficient in size to receive the strings of various diameters ranging from 0.007" to 0.070" or more while being smaller than the diameter of the ball end so as to limit the passing of the ball end through the opening or recess in order to secure or mount each of the individual strings to the body. The wrapping usually extends up to a ½" towards the plain end and as such the position of the tailpiece structure relative to the bridge element must insure that the wrapping does not extend over the second critical point when arranged on the instrument; this wrapping, under normal circumstances, is not subject to stretch compared to the rest of the string. In the relevant art, "anchoring" strings is often referred to as attaching or securing a string and understood with the limitation that the anchoring is sufficient so that the string is fixedly attached or secured to the instrument under the typical tensioned conditions of the string that typically range from 16 to 20 lbs or greater. Stable fine adjustments of these and other elements have been a longstanding problem for stringed musical instruments.

Additionally, the popularity of guitars and other multi-stringed instruments having more than the typical 6 strings and/or using longer scale lengths, etc. are capable of a greater pitch range which creates the need for strings of a larger diameter. One solution is to utilize "taper core strings" that have one or two less layers of wrap near the "ball end" of the string to go over the bridge elements. Further, a "taper wound" string simply tapers away these layers of wrap as near the ball-end of the string, so the part that goes over the bridge has a smaller diameter. "Exposed core" strings taper down to the core itself, so the core goes over the bridge and lowers the action and increases sustain/resonance. These designs are often seen on B strings, typically a low string on a five string bass, for example. The logic is that a taper core string, etc. approach will help with intonating a larger diameter string. In some of these cases the strings are mounted to tailpiece portion by inserting the string through or over the bridge elements to avoid complications due to increased string diameter. The larger diameters can be problematic given the dimensions of vintage systems.

Playing pitch or proper playing pitch or pitched string condition is generally understood by one of ordinary skill in the art to be the pitch of a guitar string relative to the remaining guitar strings when a guitar is played "in tune." For example, in a standard tuning arrangement, for a six string guitar, based on the standard A=440 Hz, the pitch of the $1^{st}$ string (highest) is tuned to note E (329.63 Hz), the pitch of the $2^{nd}$ string is tuned to note B (294.94 Hz), the playing pitch of the $3^{rd}$ string is tuned to note G (196.00 Hz), the playing pitch of the $4^{th}$ string is tuned to note D (146.83 Hz), the playing pitch of the 5th string is tuned to note A (110 Hz), and the pitch of the $6^{th}$ string is tuned to note E (82.41 Hz).

In the Proelsdorfer U.S. Pat. No. 2,304,597, string tensioning devices placed on the tailpiece for fine tuning the pitch of the strings of violins, guitars and the like, were disclosed; such pitch adjustment is quite limited in range, comprising generally an interval falling between that of a whole tone and a major third at best, and designed to offer the tuning of the strings a minor adjustment of pitch after the general tuning is achieved with the tuning pegs on the head of the instrument which traditionally first provides for raising and adjusting the tension of the strings to pitch from an untensioned condition and then setting the string. This is regarded as fine tuning and the apparatus for doing so, the "fine tuners", usually comprise an adjustment knob or thumb screw.

A familiar and very common traditional arrangement in many electric guitars comprises a thumbwheel supported bridge with moveable individual bridge elements for fine tuning the intonation or harmonic tuning for each associated string operable to adjust the height of the strings relative to the body and a separate tailpiece, often bar-like in appearance, supported by screws on each end, to secure the ball end of the strings such as the traditional Tune-O-Matic ("TOM") and stop tailpieces from the 1950's, like found on Gibson branded musical guitars such as the Les Paul's, the SG's, the Explorer's, Flying V's, etc. in addition to semi-hollow body guitars in the ES lines as well as, are found on countless other guitars from other manufacturers. In this familiar configuration, two posts with integrated thumbwheels thread into inserts in the body to adjust the height of the TOM bridge whereas the stop tailpiece comprises a bar, transverse the direction of the strings, configured to receive two screws or bolts that mount the tailpiece within inserts to body. The two posts are now standardized in many cases with integrated thumbwheels centered about 2.925" with the "bass side" set back about 0.125 relative to the nut and the tailpiece studs/inserts about 3.25" apart and rearward of the bass side thumbwheel position by approximately 1.5", although these dimensions still are often varied. Further, the TOM/Stop tailpiece arrangement, "4-post" setups provide at least 0.650" distance from body to the intonation point on the lowest or first/sixth string, although historically, the dimension varied considerably.

It is known to those skilled in stringed musical instrument design and construction that various tremolos have been proposed and utilized for varying the tension of all the strings simultaneously for the purpose of creating a tremolo sound. Further, it is known to those skilled in the art that there are a great many commonly used names for such devices, such as tremolo, tremolo device, tremolo tailpiece, tremolo bridge, fulcrum tremolo, fulcrum tremolo bridge, fulcrum tremolo tailpiece, fulcrum tremolo bridge-tailpiece, vibrato, vibrato bridge, vibrato tailpiece, vibrato bridge tailpiece, etc.

In one specific species, known as the vintage or traditional fulcrum tremolo, first introduced in Fender U.S. Pat. No. 2,741,146 ("Fender '146") shows and provides a device comprising a novel structure, which incorporates the bridge and the tailpiece. The portion supporting the bridge elements is called the bridge plate or the base plate. Further, both the bridge and the tailpiece elements connected to the base plate both move together as the fulcrum tremolo device is pivoted. In this archetype, the bridge elements and their corresponding intonation points or second critical point rotate around a single clearly defined axis, the pivot axis, the fulcrum axis, etc. Typically, in order to facilitate the fulcrum tremolo pivoting about its fulcrum axis, counter springs, as a biasing element, are utilized to counteract or counter balance the pull of the strings. Accordingly, a singular and defining aspect of the fulcrum tremolo is that the harmonic tuning is upset as the device is pivoted; and, accordingly, for an instrument equipped with a fulcrum tremolo, it is unique in that only restoring all of the strings to a proper pitched condition also simultaneously restores the harmonic tuning for all the strings. The base plate upon which the individual bridge elements are adjustably secured has a beveled ridge portion which is secured to the instrument body by six screws permitting pivotal movement about a fulcrum axis which varies the tension on the strings and produces the desired "tremolo effect"; in general, this device allowed for extensive dropping down of the pitch of all the strings and a modest upward capacity that further enabled the familiar mild pedal steel or Hawaiian guitar vibrato effect provided in gentle pivoting.

In this first vintage fulcrum tremolo, herein referred to as Type I, the metal bridge elements of Fender '146 are loosely held in place by a spring loaded attachment screw arrangement pivotally secured through openings in a small folded portion of the base plate farthest from the fulcrum axis. The bridge elements also incorporate set screws for varying the relative height of the bridge elements and, therefore, height of the respective second critical points relative to the base plate and by extension, to the body and neck.

The fulcrum tremolo is generally defined to have a base plate pivotally mounted to the body of the instrument and an "inertia block" or "tone block" or "spring block" that extends transverse the direction of the strings 90° to the base plate. The instrument body is fashioned to include a single body cavity comprising two distinctive sections. There is, first, an approximate 3.00"×1.00", generally rectangular, transverse the direction of the strings, traditional "tremolo pocket" or "trem pocket" extending generally perpendicular from the top surface of the body to meet at 90° providing two approximate 3.00" wide opposing faces, a first face closer the nut and a second face further the nut; and second the traditional, generally rectangular, approximate 4.00"×2.25"×0.775" deep, cutout extending in the direction of the strings in the back of the instrument body, a "spring pocket", to receive the spring arrangement. The spring block has a first surface closet the nut and a second surface, each surface generally perpendicular to the top of the instrument and generally parallel to the tremolo pocket first and second face. Although there are differences in specifications from one instrument manufacturer to another for the various designs of the fulcrum tremolos that are available, there is approximately 0.125" to 0.250" clearance, between the spring block and the tremolo pocket face closest to the nut, to provide for upward pitch change as the spring block pivots towards the nut. Counter springs are usually connected to the body of the instrument at one end and, on the other end, to, usually, a block of metal, milled or cast or a combination of the two, which being secured to the bottom of the base plate by three screws 90 degrees to the base plate, is often called a spring block or inertia block.

The typical spring arrangement includes, in addition to the biasing springs connected to the spring block, a "spring claw" to receive the first end of the biasing element, variably secured by two wood screws, to adjust the position of the spring claw relative to the body for a simple but cumbersome adjustment method. There is ample room for the spring block to pivot freely within the "tremolo pocket" cavity during use.

One of the most troublesome problems with prior art for the fulcrum tremolo has been maintaining the "initial position" achieved at "initial setup" when all the strings are brought to proper playing pitch as the harmonic tuning is achieved. When a musician plays on the string there is usually some kind of string stretch over time that results in the overall tuning, and thereby, the "initial position" going out of balance. Specifically, when the pitch of the string changes, the position of the fulcrum tremolo and the position of the second critical point relative to the nut changes which then instantly alters the harmonic tuning. This is especially problematic if a string breaks since the reduced force otherwise created by the tension of the broken string allows the entire tremolo to be subject to the known "backward tilt", all the remaining strings are un-manageably sharp in pitch and the harmonic relationship to the fret placement and scale length is distorted, generally, to an undesirable degree. Furthermore, when the tremolo base plate tilts forward, the end of spring block furthest the base plate tilts away from the nut; and when the tremolo base plate tilts rearward, the end of the spring block tilts towards the nut.

This singular characteristic adds complexities in obtaining the primary goal of achieving a stable equilibrium, initial position, between the force of the tension provided by the use of biasing or counter springs (connecting between the tremolo and the body) in relation to the force of tension of all the strings (connected to the fulcrum tremolo and the end of the neck at the peg head by the tuning pegs or an optional nut arrangement that secures the strings without tuning pegs, etc.)

Accordingly, these and other inherences need to be addressed in achieving a true and lasting initial position for the fulcrum tremolo and which has been the object of many inventions. In this inherent inter-dependant system of tensioning forces, contrary to the requirements of other tremolo or fixed bridge arrangements, (in the ideal instance where the essential conditions of the initial setup have been established and the appropriate tensioning force of the springs provisioned), the precise tensioning to proper playing pitch for any less than the total number of strings will inherently fail to achieve pitch and harmonic tuning for all of those strings attached to the tremolo.

Often the pivot is subject to wear and the tremolo does not always return to its initial position. Great care is required to establish the initial position, since both aspects of adjustment are interactive for "floating tremolo setups", and since it simultaneously provides both the proper harmonic tuning and proper pitch tuning for each of the individual strings in order to enable a lasting "initial setup".

Therefore, for stringed musical instruments, as is known to those skilled in the art:

The second critical point is a clearly defined point on the bridge or individual bridge elements, the adjustment of which relative to the first critical point on the nut defines the length of the string or scale length and the adjustment of which is called harmonic tuning.

For fulcrum tremolos as originated by Fender '146, when pivoted:

Both the bridge portions and the string anchoring means, the tailpiece, simultaneously move about a common fulcrum axis;

The harmonic tuning is upset and is only restored when all strings are at proper playing pitch;

The tuning pegs or other means of tensioning the strings are inter-dependant with each other in obtaining initial position; and Various factors can disturb the equilibrium point between the tension of the strings and the tension of the counter springs and as a consequence disturb the initial position.

U.S. Pat. No. 3,424,049, Nathan I. David, "Combined bridge, tailpiece and manual vibrato for guitars", ('049) describes a multi-pivot axis spring steel element operable as a one-piece "cantilevered" combination flexing bridge and tailpiece for a tremolo:

A guitar attachment having manual vibrato comprising a bridge section for a connection to the guitar surface and combined with an integral tailpiece connected to the bridge. The tailpiece is not connected to the guitar surface but is cantilevered and is therefore free for substantially vertical movement.

and a simplified structure wherein a single strip of resilient metal is formed into a bridge section which is connectable to the guitar surface. Integral with the bridge section is a tailpiece which extends freely rearwardly in cantilever fashion. The guitar strings of course extend over the bridge and are locked, as usual in the tailpiece. A handhold bar is connected to the tailpiece. Accordingly, when the handhold bar is manually vibrated, the strings ends are lifted or rocked, resulting in alternate shortening and lengthening of the strings to produce vibrato when the strings are struck.

Further,

Thus the combination structure comprises a flat, mounting or base strip 16 which is fastened to the guitar top face as by screws 17. A substantially vertical wall 18 (which is in fact slightly rearwardly inclined), integrally follows the base strip 16. Following wall 18 is the arcuately formed tailpiece 15, said tailpiece being concavo along its top surface so as not to contact 4.

And

The combined base 16, wall 18, and tailpiece 15 are formed from a single piece of spring steel of an approximate thickness of 0.1 inch. The junction line of wall 18 and tailpiece 15 forms the highest line of the structure and thereby provides the bridge 22.

Accordingly, David's bent piece of 0.100" thick flat spring material, fashioned with four transverse bends, comprises bridge 22 by vertical spring area 15 to support the strings over the fret board and a tailpiece to secure that strings which flexes, when the tremolo arm is activated, to create the required effect. Further, since the flat spring material flexes at each individual bend that forms:

1) the tremolo arm support area,
2) the tailpiece element,
3) the bridge element as well as
4) to the connection point at the body, the arrangement, with its resultant four pivot axii, create an highly individual and complex motion and interrelationship of and between the bridge elements, the tailpiece and the body as the tremolo is activated.

Further, '049 has no provision for adjusting the intonation of each bridge element or the harmonic tuning or the string height relative to the body, etc. Accordingly, this inherent behavior does not meet the requirements, indigenous to the "fulcrum tremolo" as per original Fender '146, etc., that 1) the bridge elements and tailpiece each simultaneously rotate on an essentially singular pivot axis and each follow an essentially constant arc about the pivot axis, 2) the bridge elements are adjustably positioned relative to the body for individual height and 3) adjusted relative to the nut for harmonic tuning.

For those fulcrum tremolos equipped with fine tuners as with Rose U.S. Pat. No. 4,497,236, Storey U.S. Pat. No. 4,472,750 and Fender U.S. Pat. No. 4,724,737:

The bridge and tailpiece portions simultaneously move about the fulcrum axis when the device is pivoted for the tremolo effect;

The fine tuner screws simultaneously move with the bridge and tailpiece portions about the tuning axis when fine tuning; and Fine tuners are designed to offer the tuning of the strings a minor adjustment of pitch after the general tuning is first achieved, typically, by the tuning pegs on the head of the instrument; and Adjusting the tension of a string by the fine tuner knob alone simultaneously adjusts the harmonic and pitch tuning and can achieve tuning a string to proper pitch conditions while simultaneously achieving proper harmonic tuning.

Improvements to the Fender '146 fulcrum tremolo have included Rose's "string clamps" at the nut, installed along with a "string tree" for some guitars, a horizontal bar positioned between the tuners and the "locking nut" arrangement, to facilitate stability and "string clamps" at a point on the opposite side of the intonation point or second critical point on each of the bridge elements relative to the nut in order to limit string stretch to the prime vibratory portion of the string within these two points defining the scale length.

Knife Edge Pivots for the Fulcrum Tremolo

Rose (U.S. Pat. No. 4,171,661) adopts semi-circular shaped beveled edge to the base plate, called a "knife edge", adjustably supported by two screw-like members, referred to generally as riser posts, positioned in the body to collectively improve the return to initial position after pivoting the fulcrum tremolo device. The knife edge fulcrum pivot arrangement provides for the base plate to be positioned generally parallel to the instrument body, often referred to as a "floating tremolo", for example, and offered the novel possibility to substantively increase the tension of the string for upward pitch changes by rocking the base plate "rearward towards the body" with the arm. The inclusion of iterations of Fender '146, herein referred to as Type I, to include, similar to Rose, "the American Standard", a knife-edge design on the leading edge, closest to the nut, of the base plate with a riser post arrangement adjustably connected to the fulcrum tremolo, herein referred to as Type II. In the American Standard string height is often close to 0.480 from the body and the bridge elements comprise an approximate 0.187 distance from the base plate to the intonation point or second critical point; additional height, including compensation for fingerboard radii is accomplished by set screws that displace the bridge elements from the base plate—although effective, this approach reduces coupling between the bridge and the base plate, and, in some case, unevenly since not all strings will require the bridge element adjusted off the base plate, etc. In Rose the starting height for the intonation modules is approximate 0.315 and varies to meet fingerboard radii requirements, etc., although the distance to the body varies considerably. In most instances, however, the height adjustment range is typically limited to less than 0.100", demands to reposition the devices' range are usually are met by the design of the base plate itself, or the mounting method, etc.

These two vintage fulcrum tremolos of the last century, Fender and Rose in the 80's, are in part distinguished by the differing standards for the placement of the riser posts, that receive each of the knife-edges to create a pivot axis, relative to both first critical point on the nut as well as the second critical point on the bridge element. Accordingly, there are differences in the body pocket but less so for the cutout that receives the biasing springs and the distance from the face of the spring block nearest the nut to the corresponding face of the tremolo pocket.

Other solutions to creating a dependable pivot arrangement such as on the Marcus Caldwell ("Caldwell"), U.S. Pat. No. 7,297,851 B2 (the "'851 patent"):

> A bridge assembly for a guitar having a bridge plate connected to an anchor plate by a single, horizontally positioned flat spring. The bridge plate has an opening that receives a portion of a sustain block. The sustain block has receptacles for receiving line tuners and string clamps.

Here, Caldwell shows an alternative for the knife-edge/riser post arrangement with a single unbent flat spring 38 connected to the body 12 via bracket 32 on one end and base plate 90 the other end to create single reliable resilient pivot that is operable with the traditional biasing element/spring claw/adjustment screw arrangement of the 50's Fender Stratocaster. The flat spring is not pre-tensioned and exerts no biasing force on the tremolo from initial position in either direction; the arrangement relies on Fender's original spring block/spring/spring claw arrangement to bias the tension of the strings.

Enserink Innovation B. V. U.S. Pat. No. 5,522,297, "A Tremolo bridge for guitars", shows "one or more expansion springs (155, 157)" being used to replace traditional the fulcrum tremolo spring arrangement in a knife edge/riser post arrangement.

Floating Tremolo and Tremolo Stabilizers

One disadvantage, for some players, is that a "hard" stop eliminates the original capacity for light tremolo wavering effects around initial position and upward pitch bends. Accordingly, many players today would prefer a setup that acts like a fixed bridge for small force changes like bending strings, strumming at initial position yet "gives" and acts like a floating tremolo for using the tremolo arm for larger modern, pitch changes, such as "dive bombs", as is distinguished as a "soft" stop or tremolo stabilizer. As is known, the biasing element or spring system, provides a continuous generally linear force curve to establish equilibrium at initial position, but is not capable of changing its rate of tension, in general, stretching gradually and gradually as more force is applied.

It is also known that many musicians, despite having the requisite hardware on their stringed instrument to enable a "floating tremolo" setup, intentionally choose to "block" or "stop" the fulcrum tremolo from being tilted "rearward" in order to remove the potential for an unwanted increase in pitch of the strings. This condition or setup is commonly referred to as a "blocked tremolo" or "stopped tremolo"—accordingly, the stop is considered a "hard" stop when it completely prevents pivoting the tremolo in one direction when at initial position. Additionally, as a significant part of this setup, increasing the overall tension of the biasing element past the minimum force required to make initial contact with a "hard" stop at initial position, is required to compensate for the increases in force, say 8+ pounds, in the tension string during bending notes, etc. meeting at least three objectives:

1) the tremolo stop will ensure initial position when a string breaks, so that the tremolo does not tip rearward and the rest of the strings do not go up in pitch, despite the missing counter balancing force of the un-tensioned or broken string,
2) the tremolo returns to initial position after radical use no matter what ensuring accurate tuning—to eliminate, among other things indigenous to the floating tremolo, the maintenance and care of initial position over time defined by the delicate balance of the forces and related wear and tear over time and
3) the tremolo becomes less likely to be "slightly" activated unintentionally compared to a floating tremolo, useful in general, for strumming, and makes double stops much more accessible when the force of the biasing element is increased.

Tremolo Stops to meet these needs have been created by positioning small pieces of wood, plastic, etc. approximately 0.125"~0.250 or so thick in the tremolo pocket between the spring block and the face of the tremolo pocket closest to the nut—even in "emergency" situations, a stack of guitar picks taped to the inertia block's face closest to the nut, in sufficient dimensions, can used for an evening, if need be.

Further, stopping a floating tremolo is common to meet the demands of auxiliary tension adjustment mechanisms: U.S. Pat. No. 5,359,144 ("'144") October 1994 to Robert Benson. Commercialized as the "D-tuna" mechanism for the "double-locking" Floyd Rose tremolos, the mechanism is designed to quickly re-tension the $6^{th}$ string from standard "E" down a whole step to "D" for "drop-tunings", ie., instances where the pitch of at least one string is varied compared to standard tuning—the dynamics of the forces of tension between the strings and springs require, for optimal usage, a stopped tremolo:

A pitch changing apparatus, providing bi-stable operation within a tremolo system which produces two distinct pitches for selected strings . . . .

In the Abstract:

The tension correcting mechanism is manually rotated to adjustable stop positions of required spring counter-tension, thereby keeping all strings in tune under conditions of changed total string tension.

Van Halen: (http://www.dtuna.com/faq.php):

Why do the other strings go out of tune when I drop to D?

The bridge must be stabilized first. This is done by blocking the bridge so it cannot pull up. If your bridge is stabilized and the other strings are still going out of tune, you may need to increase the overall "spring tension" by moving the spring claw further from the block.

Accordingly, it is recommended by Van Halen that the "D-Tuna" device of '144 works better with an additional element or mechanism that will provide a "hard" stop the tremolo when the $6^{th}$ string is tuned to "D", the lower of the two target pitches; and, in order to ensure initial position of the fulcrum tremolo at the higher target pitch, since a hard stop requires increasing the overall force of the biasing element sufficient to compensate for the small increase in force, which unaddressed would yield a forward tilt otherwise present at the higher-tensioned "E" target pitch.

Various mechanisms have been presented to assist the traditional biasing springs of Fender '146 in view of modern demands, such as the Hipshot branded "Tremsetter", Borisoff et al, U.S. Pat. No. 4,928,564 ("'564"). The Tremsetter device secured directly to the body's spring pocket, provides an adjustable pre-tensioned compression spring element added to complement the traditional biasing element to provide a discontinuous force curve exerted on the tremolo in order to provide an adjustable "soft" stop or tremolo stabilizer—the spring arrangement operable to increase the force required to pivot the fulcrum tremolo from initial position; its operability primarily to more firmly maintain the initial position of the floating tremolo compared to usage with an unassisted biasing element. Accordingly, when a force is exerted to move the tremolo out of initial position, that same tremolo is subject to a restoring force that is being borne by the stabilizing device limited enough in its range so that the compression spring element is active until the pre-tensioned restoring force is overcome during operation of the tremolo.

The Hipshot device and multi-spring variations like it, the Ibanez BackStop, the WD Tremolo Stabilizer, the ESP Arming Adjuster, the Goeldo BackBox, not all of which are available in the US at this time, none-the-less all comprise a compression spring-like arrangement deployed to complement the traditional biasing element, each secured to the tremolo spring pocket, tensioned upon installation to an approximate force of 8~10 pounds, capable of making variable contact with the spring block and urging the spring block in a direction away from the nut—these devices do not pivot with the tremolo about its axis—it requires approximately 4 pounds of force to "bend" a typical electric guitar unwound string a whole tone up in pitch under typical situations, 8 pounds or so of force will reinforce or ensure initial position under the conditions where two strings are bent.

Each such device employs a tensioned compression spring that seeks to stabilize initial position with an adjustable "soft" stop, to avoid the limitations of a 'hard" stop and to offer more stability in the instance of double stops which are otherwise more difficult:

A method of stabilizing a neutral position of a tremolo system including a pivoted bridge assembly including the steps of tensioning all of the strings of a guitar to a selected pitch slightly less than a desired pitch, tensioning certain counter-balance springs connected between said bridge assembly and the guitar body to oppose the string tension, and mechanically adjusting a certain counter-balance spring to bring the tension in the guitar strings to a desired pitch whereby said mechanical adjustment provides a mechanical stop for returning all of the guitar strings to a selected pre-tuned pitch.

Numerous other complementary mechanisms are secured to the tremolo spring pocket to enforce the position of the spring block such as Hirayama U.S. Pat. Nos. 6,552,252 and 6,686,524 for Ibanez include auxiliary springs to enforce initial position. Geier U.S. Pat. No. 7,427,703 commercialized as the "Tremol-no" releasable tremolo stop is also secured to the tremolo spring pocket in the body:

A quick-release tremolo lock device for installation into a tremolo recess, and for mounting to a movable bridge or a tremolo block of a stringed instrument such as a guitar. The tremolo lock device includes a spring mount that is adapted to be fixedly attached to at least one wall of the tremolo recess and configured to capture an end of at least one tremolo spring. A slide key is also incorporated into the device, which is connected to the spring mount about a proximate portion of the slide key. The device also includes an adjustable quick release slide receiver that is adapted to receive and to releasably capture a distal portion of the slide key to fix the position of the receiver relative to the slide key. The device further includes a tailpiece joined to the quick release slide receiver and configured to be mounted in a spring hole of the tremolo block.

Lavineway U.S. Pat. No. 7,189,90 is provides a tension bar connected to the body operable on the spring block to ensure initial position:

A tension bar is held against the back of a lower portion of the tone block by at least one tension bar spring when the tone block is in a neutral position. Stopping means are provided to prevent the tension bar from urging the tone block forward of the neutral position.

The Mag-Lok from Super-Vee Tremolos, secured to the spring pocket, US patent pending, is a magnet-based alternative to the compression spring arrangement to ensure the tremolo in initial position during double stop bends and the like that is overcome when the bar is used.

Smith U.S. Pat. No. 9,029,671 provides for a device secured to the "upper surface of the body" adjustably connected to the tremolo base plate operable to selectively stop a floating tremolo:

A tremolo lock as provided preferably to allow the operator to engage the lock or stop from the topside of a guitar and tremolo base plate completing a floating double locking tremolo system preferably for electric guitars.

The Hipshot Tremsetter is also known to be installed with the D-tuna in order to improve the accuracy of the predetermined target pitches for a floating tremolo. Dam's U.S. Pat. No. 7,053,287, also secured to the body's spring pocket, for a similar device secured to the spring pocket for creating a soft stop include:

A compensator for a tremolo for a stringed musical instrument, such as an electric guitar. The compensator has an integrated tremolo stop, allowing a musician to continue playing without undue delay in the event a string breaks.

Further,

The object of the present invention is to provide a compensator having an integrated tremolo stop which allows the musician to resume playing with a minimum of delay after string breakage, and to provide ready access to the tremolo stop while keeping the number and size of the openings as small as possible.

Didan U.S. Pat. No. 6,943,284 September 2005 for a retractable tremolo stop mechanism comprising a retractable cam adjustably secured to the top body surface bracketed between the spring block and the base plate:

. . . having a first inoperative position and a second operative position in which it stabilizes the bridge plate by limiting movement of the bridge plate in one direction in response to the spring means, means for maintaining said cam in said first position and said second position comprising of a frictional restraint contact with said cam, method for establishing the normal position of the bridge, The cam is selectively operable by the player between an inoperative (retracted) position, and an operative position in which it serves to stabilize the bridge plate.

The cam is pre-set with a limit stop whereby its actuation stabilizes the bridge plate at a position providing for normal tune of the remaining strings despite the failure of any one or more strings, or for purposes of tuning the instrument.

As discussed above all of the various compression spring based mechanisms described above are secured to the body, in the spring pocket, in particular, and, accordingly, do not rotate with the tremolo at any time, to make variable unsecured contact with the spring block to apply an expanding force supplied by compression springs against the spring block in a direction way from the nut to augment the linear force applied by the biasing element pulling in the direction towards the nut. In each case the adjustment members are very small, often positioned between the individual springs of the biasing element and difficult to adjust initially and to compensate for changes over time.

The Global Tuner invention offers a quick way to adjust the dynamic relationship between tensioning forces between the strings and springs with a thumbwheel to maintain "initial position" over time.

DETAILED BACKGROUND OF THE INVENTION

World-famous Kahler Tremolo (Storey U.S. Pat. No. 4,457,201) ("201") and Kahler U.S. Pat. No. 7,521,616 ("'661") provided a mounting frame to support a pivoting plate comprising fine-tuners and adjustable bridge elements in a slim-profile design to fit most Gibson-style guitars 4-post TOM/Stop format without modification comprising resilient or spring members to create a counter tension for string tension.

In each Kahler tremolo, a unique mounting frame is configured to be secured to the surface of the body of the stringed musical instrument with at least one attachment post secured to the rear inserts, preferably, in the 4-post configuration including a pivoting base plate assembly element operable to secure the strings, with provisions to fine tune their individual pitches, mounted 1) with respect to the mounting frame, and, by extension, to the attachment posts, and, thereby, 2) the body. The base plate assembly element is formed with a first surface closer the mounting frame operable to receive counter springs and a second surface further the mounting frame for securing string mounting assemblies. At least one post, comprising a screw, extending from the mounting frame, secures the resilient member assembly on one end. The other end of the spring member is further connected to the pivoting base plate assembly element, comprising 1) the tailpiece portion and 2) the string mounting assembly element wherein each element connected to the mounting frame, the coil spring resilient member assembly to provide a stabilizing force acting against the tension force in the strings.

In this vintage design from 35 years ago updated in. Kahler's '661 2009 effort, each second critical point, created by each associated bridge element collectively secured to the mounting frame, remains stationary relative to the nut such that the harmonic tuning is stable and not upset by the change in pitch of the strings when the tremolo is activated whereas Floyd Rose's FRX, Top Mounted Tremolo and Tuning Apparatus, U.S. Pat. No. 8,946,529 B2 ("'529"), Feb. 3, 2015, upsets the harmonic tuning like Fender '146 when the pivoting base plate is activated for the tremolo effect.

The Rose apparatus, like '201 and '661, includes a stationary mounting frame for top mounted 4-post TOM applications to support a pivoting base plate tremolo comprising the fine-tuners and tailpiece element with springs positioned between the base plate and the mounting frame plate to obviate the traditional spring block that pivots within the body of the instrument. Included is a second or opposing force counter spring arrangement to stabilize, similar to Hipshot above:

The apparatus includes a mounting frame configured for mounting on the surface of the body of the instrument, an attachment post secured to the body, a base plate pivotally mounted with respect to the attachment post and having a surface adapted to receive a force, a mounting assembly mounted on the base plate for holding a string of the instrument, and a first resilient member assembly for engagement with the mounting frame outside the body of the instrument and supplying a stabilizing force to the base plate against a tension force in the string. The apparatus includes a second resilient member assembly configured to be engaged with the mounting frame outside the body of the instrument and to supply a force to the base plate surface adapted to receive the force.

Further, Steinberg, U.S. Pat. No. 496,385 S1, ("'385") tremolo comprising a stationary mounting frame secured to the body of the stringed musical instrument with at least one attachment post, a spring member arrangement connected to the mounting frame by a screw post on one end and to a base plate assembly on the other.

Like Rose and Mahler, the '385 base plate assembly is pivotally supported by a stationary mounting frame. The base plate further comprises individual bridge elements, tuning capacity and the tailpiece function. A coil spring resilient biasing element connecting the base plate and the support plate stabilizes the force of the tension of the strings; and further, like in Rose '529, when the '385 tremolo base plate is pivoted, the harmonic and pitch tuning is upset.

SUMMARY OF THE INVENTION

Integrated Pivot Spring Tremolo

One primary object of the present invention is to integrate the tremolo pivot or the tremolo pivot axis with the biasing element comprising a formed flat spring having at least one flexible bend comprising a tremolo pivot axis, positioned in essentially the same place as the axis of a traditional fulcrum tremolo, at the leading edge of the tremolo closer to the nut, transverse the direction of the strings, secured between the tremolo base plate, adjustably supporting the intonation modules, and the body or support plate. The variable force of tension in the bend of the flat spring is operable to 1) hold the base plate in initial position under normal load of the force of tension created by the strings, typically between 85 to 100 lbs., 2) to increase the acoustic coupling between the base plate/bridge elements and the body such that 3) upon moving the traditional tremolo arm in the normal manner, flexing the formed flat spring on a axis at the bend to tilt the position of base plate toward or away from the nut and/or body to mimic the unique fulcrum tremolo effect when pivoted. In a preferred arrangement, typical features such as spring tension, string height relative to the body and intonation, etc., are adjustable.

This arrangement, like Kahler '201 and '661 and Rose '529 obviates the traditional tremolo spring block pocket and the spring pocket body cavities, for a top mounted or surface mounted tremolo, such that the entire tremolo is mounted to the top surface of the body, secured by mounting screws threadedly engaged with the body whilst providing all the benefits and characteristics of a floating fulcrum tremolo arrangement fully capable of the familiar dropping and raising pitches by the tremolo bar. Accordingly, the traditional spring block, resilient member/coil spring/biasing element and mounting claw arrangement in the back of the body are no longer required.

In one primary embodiment, in order to save space, the spring can have a U-shaped profile positioned between the base plate, obviating knife edges, bearings or other arrangements, etc., and the body or adjustable support plate—typically, the spring will be formed with a pre-tensioned capacity that could look like a "bobby pin" in profile, for example, and then under appropriate string tension brought to a condition wherein both the upper leg and the lower leg are essentially parallel to each other.

In a preferred embodiment, the U-shaped spring, comprising an upper leg and a lower leg, the upper leg supporting the base plate and the lower leg contacting the support frame plate is bend so that the two legs, in one preferred arrangement, are essentially parallel when the (six, for example) strings are tuned to proper playing pitch—for example, a typical set of lighter electric guitar strings (starting with 0.009" first string) collectively require about 85 lbs of tension and about 100 lbs for "light" sets (starting with 0.010" first string) for typical tuned pitched conditions. Alternatively, the pivot spring can be L-shaped with one leg secured to the body and the other to the base plate at, say, 90°, supporting the bridge elements wherein the bend creates both the tremolo pivot axis and the requisite biasing force to return the pivoting base plate and thereby the bridge elements to initial position established at setup.

Accordingly, different rates of springs can used, and an adjustment mechanism to alter the available force for different requirement is offered. Adjusting the force of the pre-tensioned U-shaped flat spring is achieved by tilting the spring's position relative to the body a few degrees so that the relationship of the force associated with the original axis of the U-shaped pivot spring relative to the force of the strings is altered. Accordingly, adjusting the tilting of the spring away towards the body will increase the amount of tension required to establish initial position and tilting the spring away from the body will decrease the force of strings to counter balance the spring to establish initial position. Shims, for example, can be added between the base plate and the upper leg or between the support plate and the lower leg to provide foe re-tensioning to initial position. Additionally, lever mechanisms, thumbwheels or setscrews, for example, can be positioned operable to tilt the position of the dual function spring to globally tune the spring force.

By limiting the OD of the semi-circular U-shaped bend to preferred sizes close to 0.281~0.375, for example, the support plate is dimensioned to receive the spring, the base plate with bridge elements etc. for a low-profile product that can fit onto the familiar 4-post TOM/Stop arrangement as a drop in fit and still operate with the familiar feel and characteristics of a traditional fulcrum tremolo. Larger radii bends comprising various thicknesses and shapes can be used for the flat spring as well as different dimension for the bridge elements, for example, to achieve the approximate 0.675 dimension from the body to the lowest strings supported by the TOM.

A second primary improvement is to add stabilizer devices or stop devices to the base plate itself to complement the biasing element aspect of the spring pivot, as opposed to the spring block that extends through the body [see McCabe U.S. application Ser. No. 14/945,035 2015]. In this instance, the improvement is directed to dual pre-determined compression spring based stabilizers, secured to the base plate operable to make initial contact with a surface on the support plate or body to complement the integrated pivot spring element to comprise a limited discontinuous force operable to increase the force required to pivot the fulcrum tremolo from initial position. The "soft" stop or tremolo stabilizer arrangement comprising, for example, pre-tensioned compression spring arrangements, including the use of spring plates in various shapes, sizes, etc., secured to the support plate or installed in a position moveable with the base plate, to complement the force of the biasing element at initial position. Accordingly, when a force is first exerted to move the tremolo out of initial position, that same tremolo is immediately subject to a restoring force that is being borne by the stabilizing device limited enough in its range so that the compression spring element is active until the pre-tensioned restoring force is overcome during operation of the tremolo. Further, other flat springs or coil springs can be added to the integrated pivot spring element to enforce initial position.

The base plate provides two threaded openings, each positioned in the trailing edges portion on each side of the base plate, each opening is operable to receive a variety of elements to make initial contact the support plate or body at initial position. For example, 1) correspondingly large setscrew, say 10M, threadedly adjustable to stop or block the tremolo at initial position from moving in one direction or 2) an adjustable stabilizer devices comprising a compression spring element to complement the U-shape biasing element pivot improvement to enforce initial position—further, 3) L-shaped or other shaped resilient elements can be bent or formed sufficiently to comprise a pre-determined force positioned to expand against either the base plate or support plate at initial position, and which in combination with the biasing element creates a discontinuous force sufficiently focused on a small rotational field to reinforce initial position and mild enough to allow the player to utilize the tremolos' intended capacities more fully; or 4) coil springs are operable to provide a counter force to reinforce initial position as well. Alternately, say, 5) a removable 2 mm thick foam rubber strip, or such with sufficient elasticity could be positioned between the spring upper and lower legs operable to comprise a force sufficient to reinforce initial position for stabilized strumming, etc.

In a preferred embodiment, the tremolo stabilizer comprises a housing threadedly secured to the base plate extended portion. The most preferred arrangement having a housing and coil or wave spring at one end, a support collar or guide element variably positioned within a tensioner element and the formed openings in the in the base plate, an adjustment pin threadedly connected to the collar operable to variably extend the adjustment pin to the support plate or body. The adjustment pin can comprises a rounded tip and sometimes comprises a ball bearing element or other approaches. The device includes the pre-compression of the internal compression spring within the housing of the stabilizer to comprise a pre-determined force of approximately 4 pounds determined at the factory at the time of assembly. A player can adjust the pre-tensioned condition of the compression spring by rotating the housing or tensioner element. Accordingly, the apparatus comprises a limited discontinuous force operable to increase the force required to pivot the fulcrum tremolo from initial position. The adjustment by the tensioner element of the force of the internal compression spring is independent of the adjustment of the forces of the biasing element to provide finely adjusted pre-tensioned forces of the stabilizer arrangement.

A second integrated apparatus also based on a resilient element having a pre-tensioned U-shaped with a least one pivot axis transverse the strings is provided to 1) increase coupling between bridge elements and the body and to 2) adjustably support the fixed height of the bridge elements relative the fingerboard. The integrated apparatus, having one leg further from the body and another leg closer to the body, comprises an "open end" opposite the U-shape end. The integrated apparatus comprises at least one adjustment screw connected to the open end. Threading the adjustment screw is operable to threadedly vary and fix the distance between the legs, and thereby, to fixedly adjust the height of the strings relative to the body. In one further preferred embodiment, a second adjustment screw in the open-end is provided for lateral adjustment of the associated bridge elements; the adjustment screw can further include thumbwheels to improve ease of use.

A support frame or plate threadedly connected to the body to adjustably support the integrated apparatus is preferred. Adjustment features could alternatively include shims, for example, to reposition the range of string height adjustment created by the relative position of the legs in the integrated apparatus.

An alternative Coupling Semi-stabilizer is presented reminiscent of McCabe U.S. patent application Ser. No. 14/945,035. Instead, the alternative Coupling Semi-stabilizer improvement, a formed pre-tensioned L-shaped flat spring, is directly secured to the instrument body by a first leg. A second leg, extending in a direction away from the nut, is operable to inter-cooperate with the traditional tremolo spring block and spring arrangement to provide a pre-tensioned force to ensure initial position. The shape of the L-shaped flat spring can comprise other shapes, such as those with a semi-circular profile, coil-like features, etc. or in combination can be extended to create compound responses of resiliency.

For those skilled in the art:

"Initial position" refers to the position of the fulcrum tremolo and, therefore, the position of the second critical point on the bridge elements in relation to the first critical point on the nut such that the tension of the strings, each at the intended proper pitched condition, the spring block, and the appropriately tensioned counter springs, renders a specific equilibrium point wherein the harmonic tuning for all the strings is simultaneously achieved.

"Macro-tuners" refer to tuners with the capacity to raise and adjust the tension of the strings from an untensioned condition to a proper playing pitch, and as such provide for alternate tunings and compensation for substantial string stretch during the life of the string essentially without additional means.

"Global Tuner" refers to an adjustment device added to a fulcrum tremolo and its associated counter spring or biasing element arrangement with the capacity to essentially re-establish the equilibrium point, created at the time of the initial setup by the tension of the counter spring(s) and the tension of the strings, in order to compensate for changes in tension requirements on the strings and/or the counter springs due to various factors. The Global Tuner preferably employs an adjustment knob or thumbwheel element for providing continuously variable adjustment of the tension in the strings by varying the relative distance between the spring attachment portion connected to the fulcrum tremolo and the attachment point of the springs to the body of the instrument. The Global Tuner thumbwheel portion provides a simple and quick means for the musician to adjust the initial position of the fulcrum tremolo in order to meet the pitch requirements in varied environmental or other situations and, in re-establishing the initial position, allows the full range of pivoting the fulcrum tremolo.

"Initial contact" refers to instance of an adjustment when a tuning mechanism first touches the instrument body, the tuning mechanism operable to affect initial position in a fulcrum tremolo.

A "hard" stop provides initial contact operable to impede rotation of the fulcrum tremolo in one direction at initial position; the "over-tightening" of the biasing element requirement to reinforce initial position obviates a global tuner.

"Tremolo Stop Tuner" refers to device integrated into a fulcrum tremolo spring block, moveable therewith about the tremolo pivot axis, comprising a holder element comprising an extended portion operable to either variably contact the body with the capacity to stop or block the tremolo at initial position, adjustably support a spring element to enforce initial position or global tune an independent stabilizer arrangement enforcing initial position.

A "soft" stop provides initial contact operable to affect a limited discontinuous force curve exerted on the tremolo spring block to adjustably impede rotation of the fulcrum tremolo in one direction at initial position. The adjustability obviates a stop mechanism.

"Initial condition" refers to the instance of an adjustment of the force operable at initial contact to complement the force of the biasing element when at initial position for a "soft" stop.

A "Tremolo Stabilizer" refers to a spring element based arrangement added to the base plate, support plate or fulcrum tremolo spring block to make initial contact with sufficient force to complement the essentially linear performance of the biasing element to create a discontinuous force curve to enforce initial position. Accordingly, when a force is exerted to move the tremolo out of initial position, the tremolo is subject to a restoring force that is borne and defined by the pre-tension stored in the compression spring element until the restoring force is overcome or disengaged during deeper rotation or pivoting of the tremolo. Given sufficient focus of the discontinuous force at initial position to impede rearward tilt, the soft stop arrangement can be combined with an auxiliary quick pitch change apparatus, like the Drop Tuner—McCabe U.S. patent application Ser. No. 14/880,271 ("'271") or any device with the capacity to quickly change from one adjustable predetermined pitch to another adjustable predetermined pitch and back to ensure the tremolo remains at initial position when the higher tensioned string is toggled to a lower tensioned condition.

Also shown is a locking macro-tuner bridge element mechanism comprising an articulated extended tip of extended laver-clamp improvement to facilitate threading a string through the nose slot to pivot or lift the clamp lever for successful loading of the string from a direction opposite or distinct from the traditional direction of operation carried out from the direction the tailpiece portion securing the string to the instrument.

Figure 3:
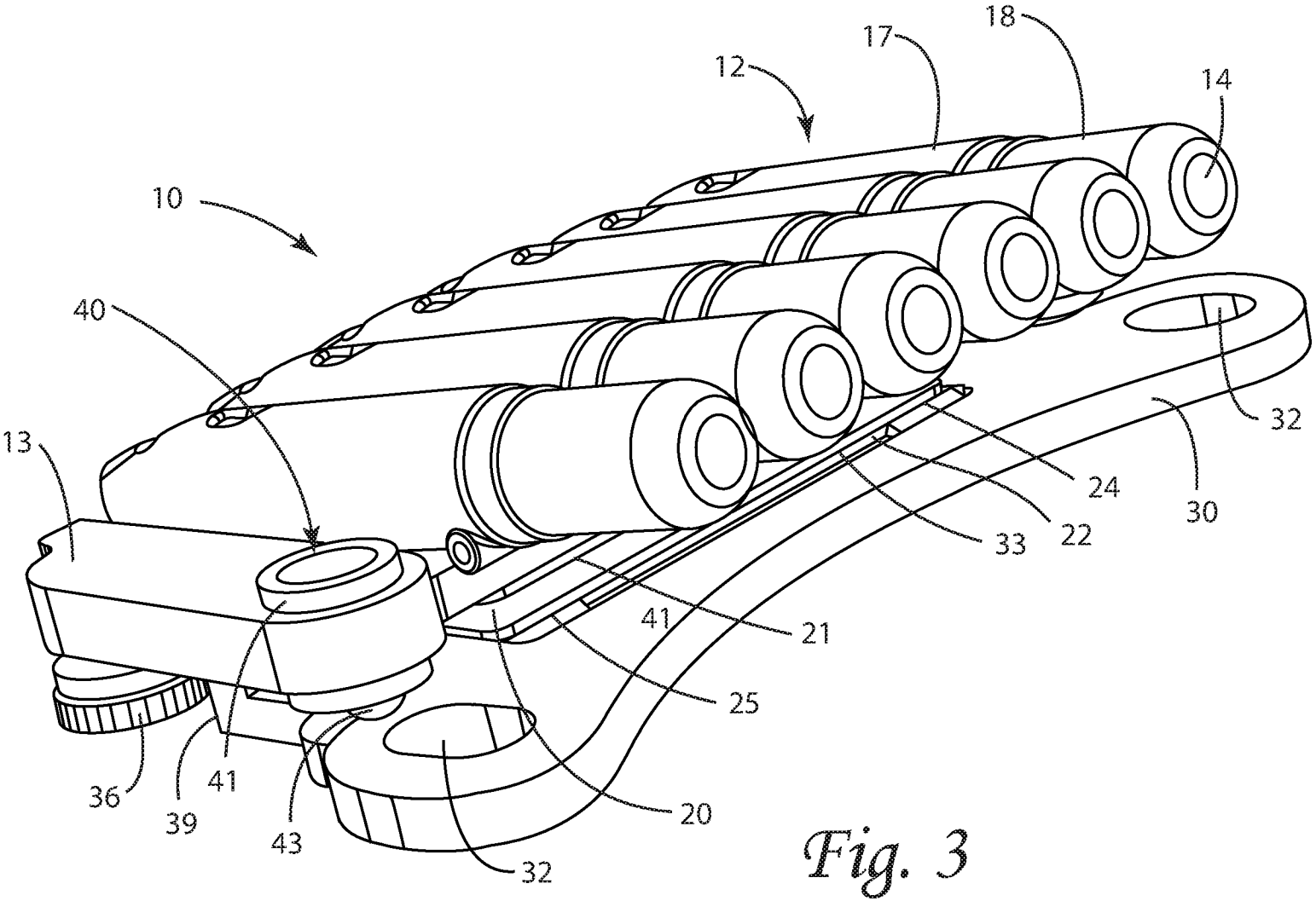

FIG. 3 is an exploded view of the novel self-contained fulcrum tremolo mechanism. A pre-tensioned compression spring-like element, supportedly positioned by the extended wing portion of the base plate operable to exert a variable limited force at initial contact to enforce initial position. The compression spring-like element complements the biasing element to create a variable "soft" stop or tremolo stabilizer. Threading the adjustment element or tensioner in this setup is operable to variably adjust the rate of the force of the pre-tension in the context of the configuration's interdependence of the biasing element at initial position. The stabilizer comprises a tensioner element including a guide element, a fine adjustment element, a pre-tensioned compression spring and washer; the tensioner element is threadedly connected to the base plate extended wing-like portion, positioned near the Stop mounting screws. The tensioner element formed to receive the washer, the resilient element and guide element, compression spring positioned between the guide element and the washer, threading the tensioner element adjusts the pre-tension of approximately 4 pounds, twin mechanisms are used, one on each side of the tremolo operable with sufficient force to variably enforce initial position. The fine adjustment element is theadedly secured within the guide element and operable to adjust the tip in dimensions up to more than 0.250 from the base plate to the support plate for making initial contact. Since threading the tensioner element is independently operable to variably adjust the rate of the force of the pre-tension, this configuration benefits from the increased stability and improved acoustic coupling set screw improvement and frees the thumbwheel element to global tune the stabilized initial position over time.

FIGS. 5 and 6 show two alternative Tremolo Stabilizer embodiments in profile where the thumbwheel function is also independent of the adjustment of the stabilizer. FIG. 5 shows a profile view of the Tremolo Stabilizer improvement shown in FIG. 4 including its relative position in the tremolo pocket area at initial contact. FIG. 5 shows a single adjustable stabilizer mechanism capable of exerting a combined force of at least 8 to 10 pounds to variably ensure initial position.

FIG. 6 shows an adjustable stop tuner configured for a setup with a global tuner wherein a further alternative example of a Tremolo Stabilizer comprises a single pre-tensioned L-shaped bent piece of sheet metal positioned between the tremolo base plate, and moveable therewith, with the short leg between the spring block element and the base plate and the longer leg extending with a mild curve at the tip for initial contact with the tremolo pocket as shown in FIG. 3. Pivoting the tremolo to flatten pitches engages the pre-tensioned L-shaped spring steel stabilizer mechanism to reinforce the initial position. A setscrew operable to variably contact the L-shaped long leg to modify the rate of the spring is presented. Further, the biasing element can be adjusted.

Figure 7:
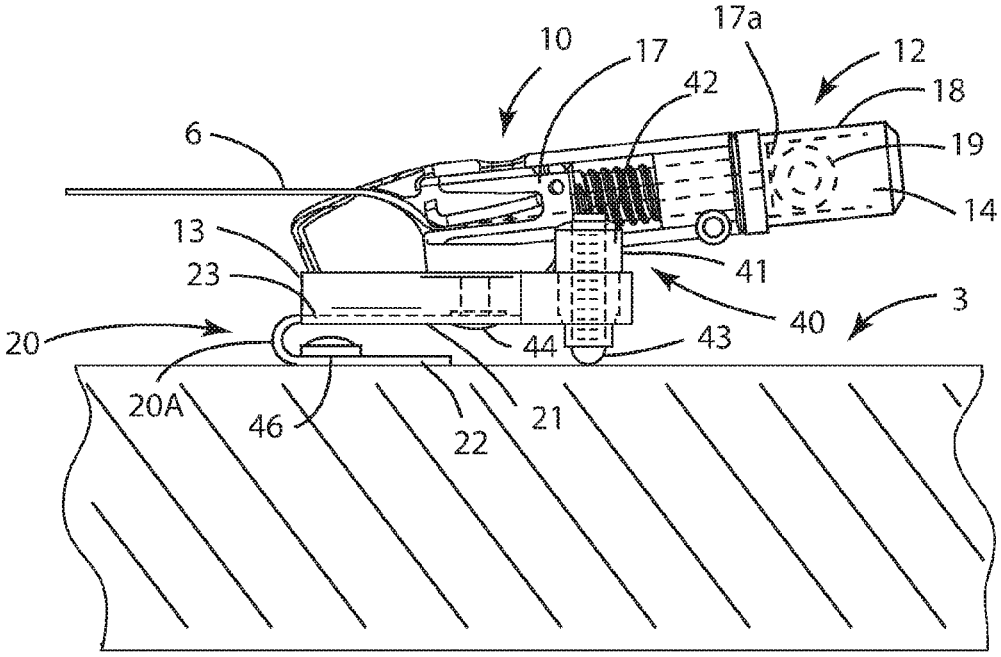
Figure 8:
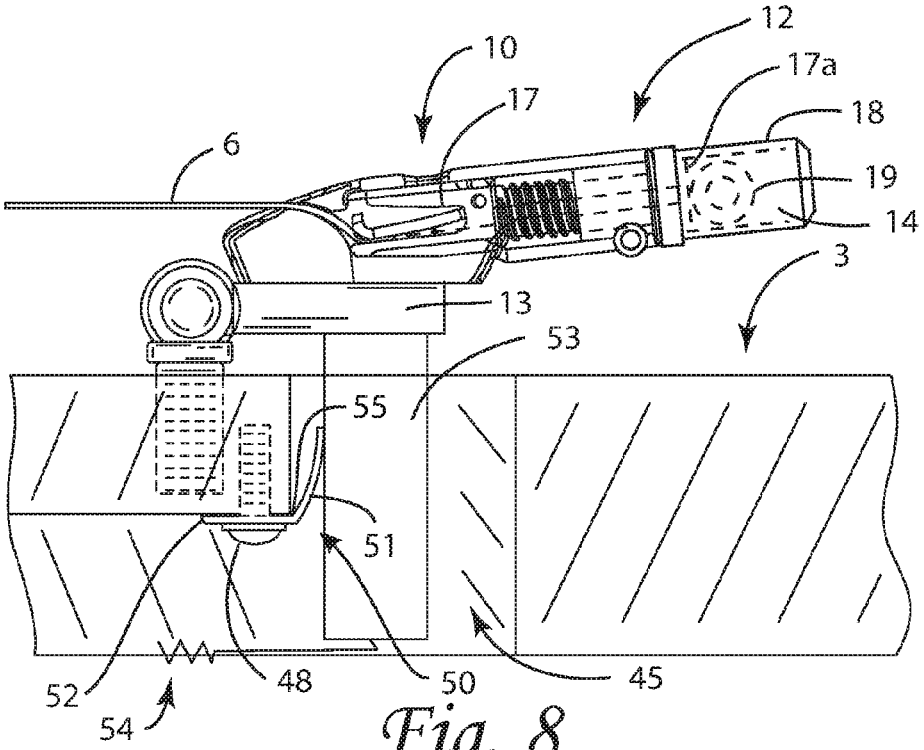

FIGS. 7 and 8 show two primary fundamental embodiments each notable for not employing an extended portion or thumbwheel.

FIG. 7 comprises another profile view showing the traditional spring block further comprising, and thereby moveable therewith, an adjustment element and set screw arrangement each threadedly engaged with the spring block. The adjustment element is threaded within the spring block to make initial contact with the instrument body to "stop" a tremolo; the setscrew secures the position and improves coupling between the three parts.

DETAILED DESCRIPTION OF THE INVENTION

Figure 1:
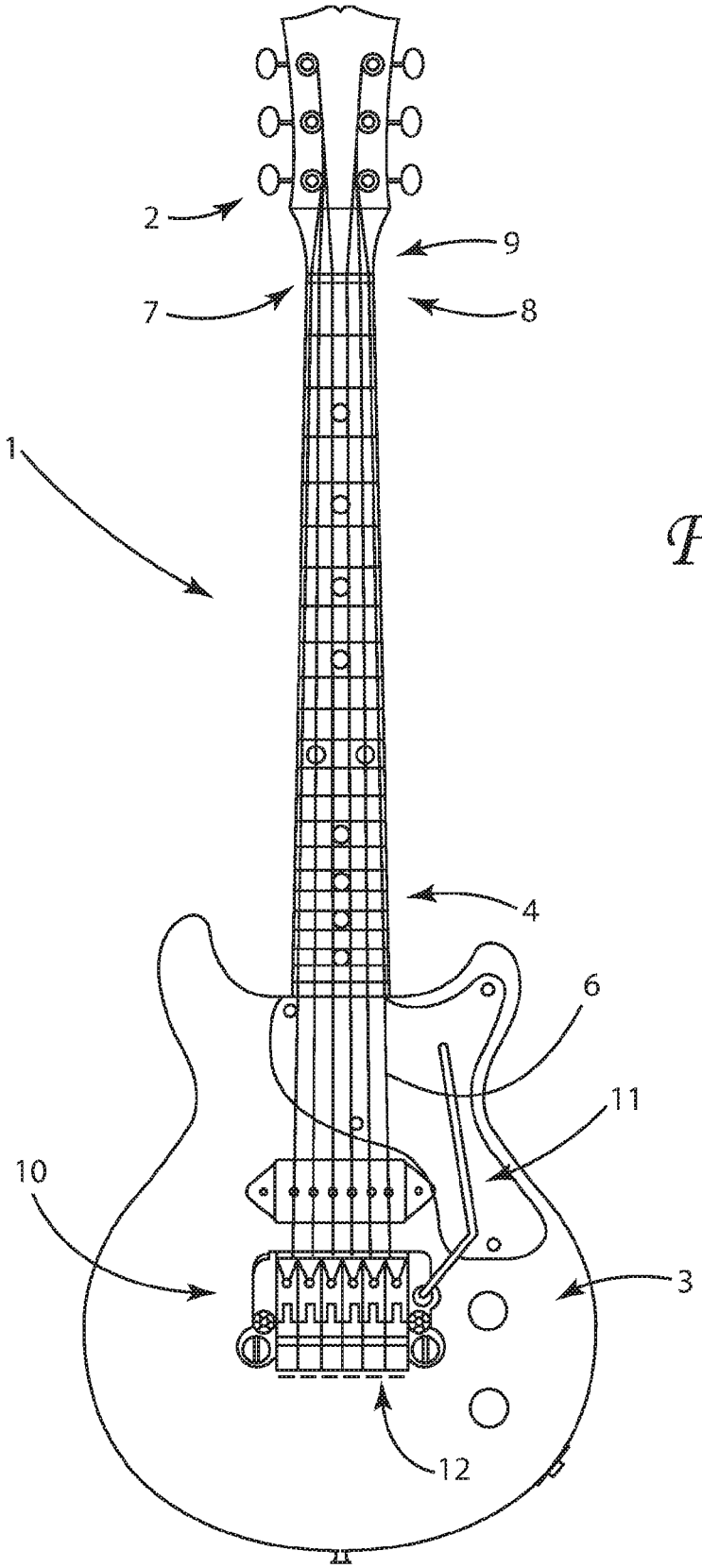
FIG. 1 is a plan view of an electric guitar embodying the present inventions.

In FIG. 1, an electric guitar 1 is illustrated comprising head 2 at one end, a body 3 at the other end, with neck 4 extending between head 2 and body 3. Six of each string 6 extends from head 2 to body 3 over neck 4. Neck 4 forms fret board or fingerboard 5 for guitar 1. At head 2, each string 6 extends over nut 7 forming first critical point 8 for each string 6. Nut 7 is located at the transition of neck 4 to head 2. Each string 6 is secured on head 2 by a corresponding element 9. On body 3, strings 6 are secured to fulcrum tremolo 10. Fulcrum tremolo 10 has arm 11 for pivoting tremolo 10 to provide the vibrato effect on the strings. Fulcrum tremolo 10 has six intonation modules 12, one for each string 6. By manipulating tremolo arm 11, the entire fulcrum tremolo 10, not including the riser posts and inserts (and in varied designs, related bearing assembly elements), can be pivoted to achieve the desired tremolo effect.

Intonation module 12, shown as a macro-tuner, a string tuning device incorporating the function of bridge or saddle and tailpiece elements, is provided to support string 6. Intonation module 12 is slideably adjustable on base plate 13 to adjust the relative distance between first critical point 8 and second critical point 16 (FIG. 2) to adjust the harmonic tuning as such. Fulcrum tremolo 10 comprises a second critical point 16, one for each string 6, sometimes characterized as an intonation point, witness point or bridge point.

The invention is shown for on electric guitar 1 with six strings 6 and it should be understood that the invention could be used on a variety of stringed musical instruments. In body 3 of guitar 1 there are electric pickups shown without numbers. In the following description, fulcrum tremolo 10 will be described in greater detail.

Figure 2:
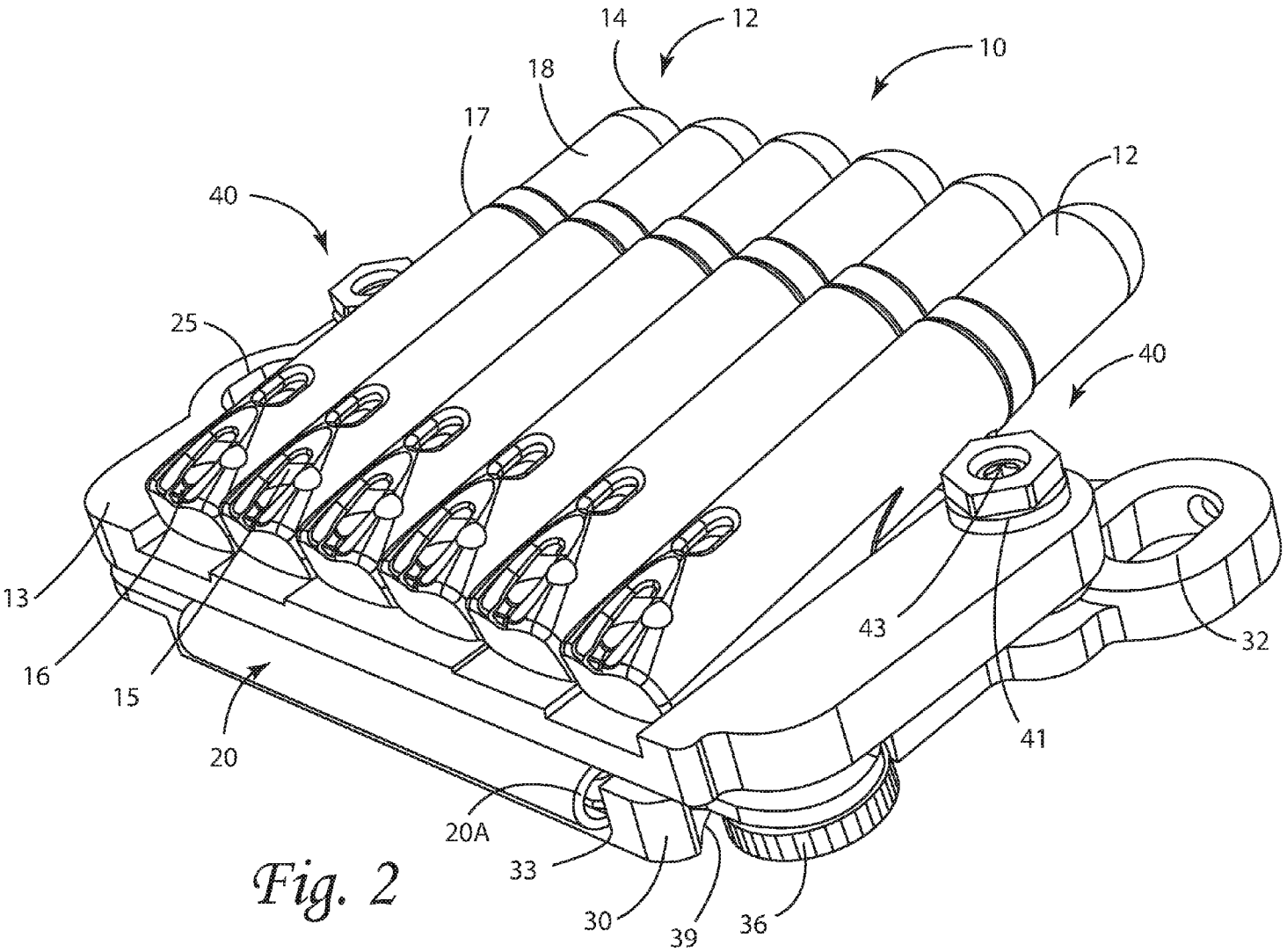
FIG. 2 is a side view of the novel self-contained fulcrum tremolo mechanism showing a formed resilient member, a U-shaped flat spring, comprising at least one tremolo axis transverse the direction of the strings positioned between the support plate and the base plate, etc. showing the traditional thumbwheel riser post and adjustment/attachment screws adjustably securing the improvement on the guitar. In this depiction, each of the two extended base plates support a stabilizer device shown making initial contact with the support plate. Alternatively, a setscrew or adjustment member can be threadedly connected to the two extended portions to make initial contact with the support frame plate, etc. or the body to "stop" the tremolo.

FIG. 2 displays surface mounted fulcrum tremolo 10 in a perspective frontal view having six of each intonation module or macro-tuner 12, macro-tuner body 17 incorporating the bridge or saddle forming intonation point 15, and tuning knob 18 (not shown: the enclosed string pitch tuning element 17 forming tailpiece 17*a*, ball-end recess 14 in tuning knob 18 to receive ball end 19 of string 6), adjustably secured to base plate 13. The leading-edge portion of tremolo 10 shows a formed flat spring, U-shaped tremolo axis spring 20*a*, the U-shape bend, operable to hold a variable force of tension, transverse the direction of the strings forms at least one tremolo axis 20*a*, U-shaped tremolo axis spring 20 positioned between base plate 13 and support plate 30 to adjustably support base plate 13, and, thereby, macro-tuners 12, pivotally relative to body 3 for the fulcrum tremolo effect. Shown is one traditional Tune-O-Matic-style thumbwheel 35 positioned between body 3 (not shown) and Support Plate 30 for adjusting the height of U-shaped tremolo axis spring 20, base plate 13 and bridge elements 12 and, thereby, string 6 relative to body 3. Tremolo arm 11 (not shown) is secured in arm support opening 25. Manipulating tremolo arm 11 in the traditional manner will bend the U-shaped tremolo axis spring 20 to pivot base plate 13 and intonation module 12 around bend pivot axis 21*a* towards or away from body 3 for the fulcrum tremolo effect. Tremolo Stabilizer 40, positioned in the trailing edge of the "wings" abase plate 13, comprises tensioner 41, pre-loaded coil spring 44 [not shown] and threaded adjustment member contact pin 43 to make variable contact with support frame 30 at initial position, operable to pivot the tremolo base plate on bend pivot axis 20*a*. At or around initial position threading contact pin 43 flexes the formed flat spring to adjust, the height of the strings relative to the body. Tremolo Stabilizer 40, complements flat spring U-shaped spring pivot element 20 to comprise a limited discontinuous force operable to increase the force required to pivot fulcrum tremolo 10 from initial position in one direction.

FIG. 3 displays surface mounted fulcrum tremolo 10 in a perspective rearward view showing fulcrum tremolo 10 having six of each macro-tuner 12 incorporating the macro-tuner body 17 forming bridge or saddle forming intonation point 15 and including tuning knob 18, (not shown: the enclosed string pitch tuning element 17 forming tailpiece 17*a*, ball-end recess 14 in tuning knob 18 to receive ball end 19 of string 6), base plate 13, a flat spring comprising U-shaped axis spring 20 comprising bend 20*a* comprising tremolo, Support Plate 30 and Stabilizer Assembly 40. U-shaped tremolo axis spring 20 further comprises at least one tremolo pivot axis 20*a* in the flexible bend, transverse the direction of the string, a first portion 21 and a second portion 22. The U-shape bend operable to hold a first variable force of tension, a first portion 21 is positioned in recess 23 in support plate 30 to pivotally support, on tremolo pivot axis 20*a*, base plate 13, and, thereby, macro-tuners 12, relative to body 3 for the fulcrum tremolo effect. Shown is one traditional tune-o-matic thumbwheel 35 threadedly secured to body 3 [not shown] within support plate 30 partial cutout 39 for adjusting the height of support plate 30, U-shaped tremolo axis spring 20, base plate 13 and bridge elements 12 and, thereby, string 6 (not shown) relative to the body. Tremolo arm 11 (not shown) is secured in arm support opening 25. Manipulating tremolo arm 11 in the traditional manner will flex the U-shaped tremolo axis spring 20 to pivot base plate 13 and intonation module 12 around pivot axis 20*a* towards or away from body 3 for the fulcrum tremolo effect. Tremolo Stabilizer 40, positioned in the trailing edge of the "wings" of base plate 13, comprises tensioner 41, pre-loaded coil spring 44 [not shown] and threaded adjustment member contact pin 43 to make variable contact with support frame 30 at initial position, operable to pivot the tremolo base plate in one direction on pivot axis 20*a*. At or around initial position threading contact pin 43 flexes the formed flat spring to adjust the height of the strings relative to the body. Tremolo Stabilizer 40, complements flat spring U-shaped spring pivot element 20 to comprise a limited force operable to increase the force required to pivot fulcrum tremolo 10 from initial position iii one direction.

Figure 4:
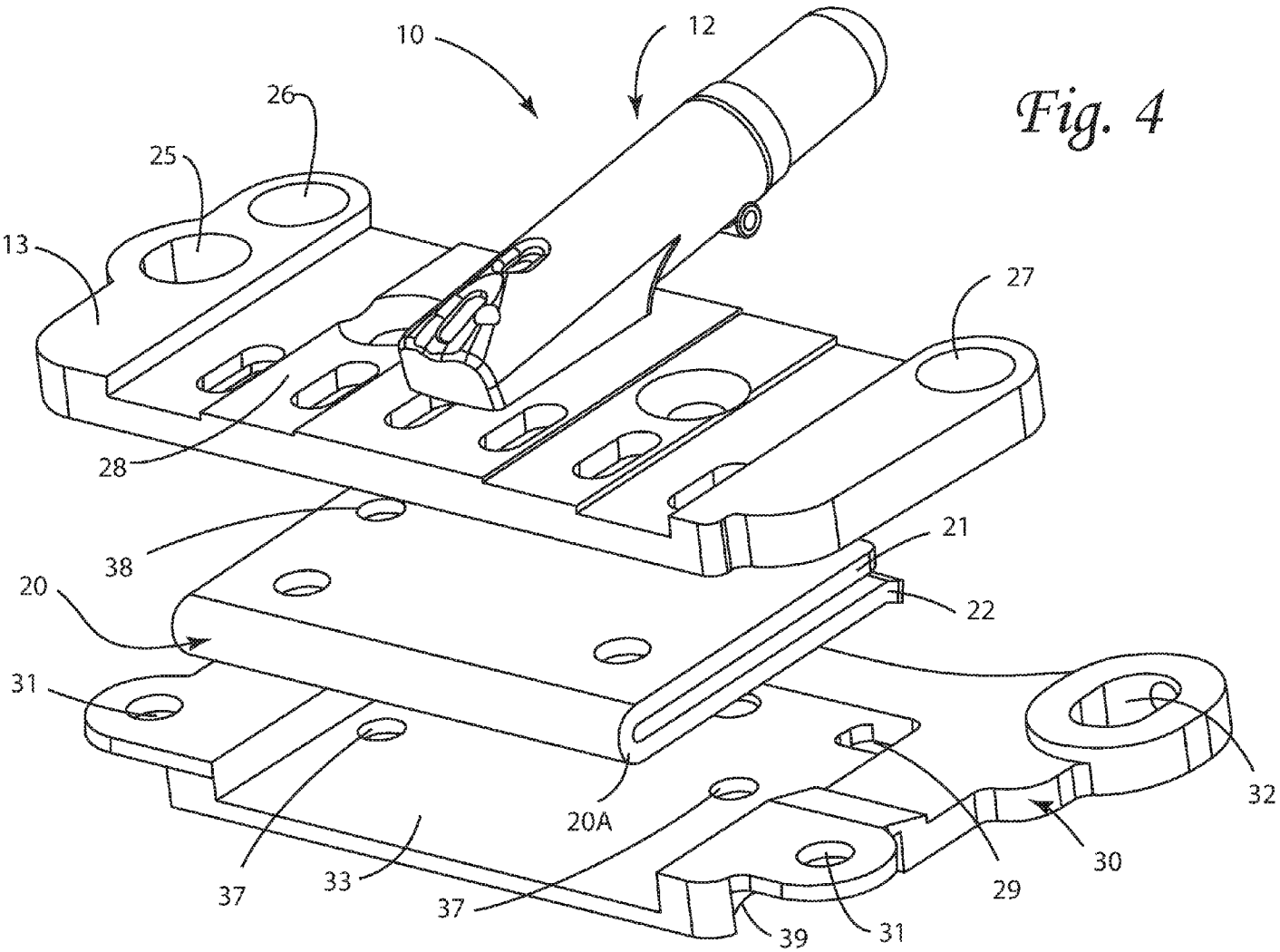
Figure 5A:
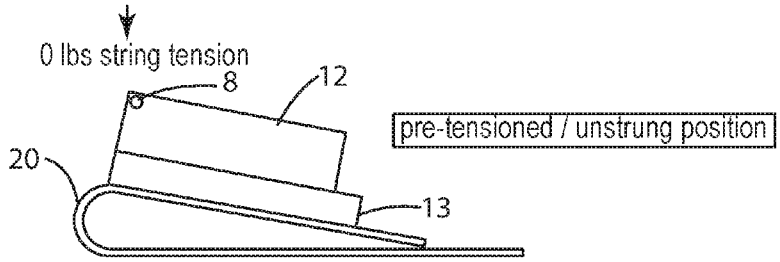
Figure 5B:
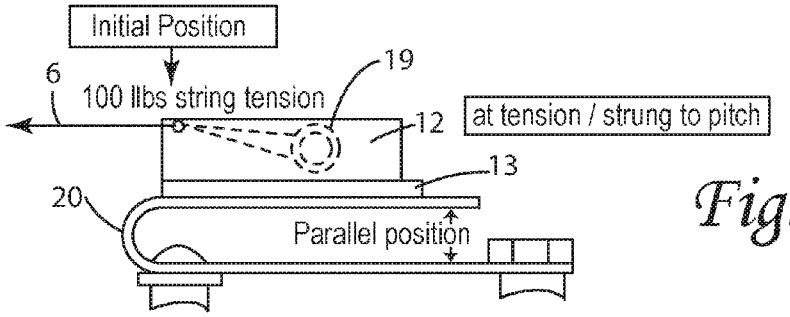
Figure 5C:
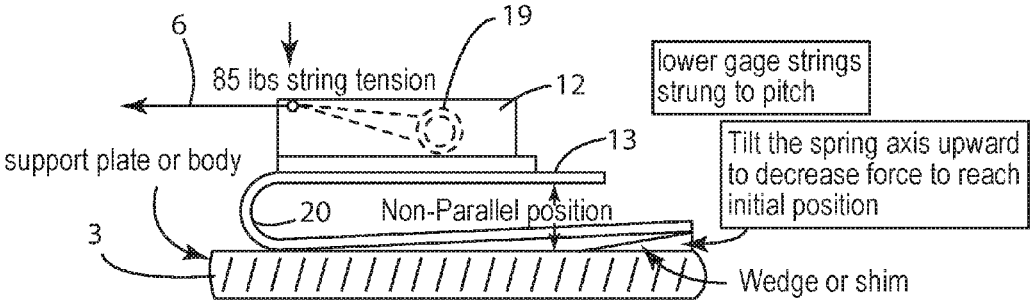
Figure 5D:
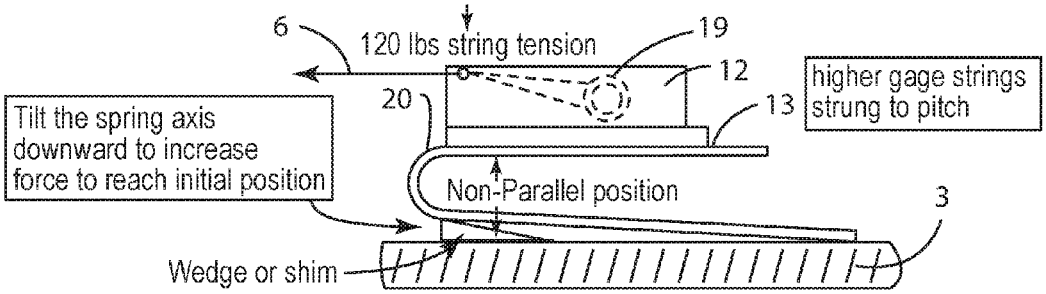

FIG. 4 displays surface mounted fulcrum tremolo 10 in an exploded perspective frontal view showing fulcrum tremolo 10 having six of each intonation module or macro-tuner 12 incorporating the macro-tuner body 17 forming bridge or saddle forming intonation point 15 and including tuning knob 18, (not shown: the enclosed string pitch tuning element 17 forming tailpiece 17*a*, ball-end recess 14 in tuning knob 18 to receive ball end 19 of string 6), base plate 13, U-shaped tremolo axis spring 20 and support plate 30. U-shaped tremolo axis spring 20 comprises upper leg 21 secured to base plate 13 and lower leg 22 seated within recess 33 and secured at screw holes 37 and tab opening 29. The leading-edge portion of tremolo 10 shows the U-bend operable to hold a first variable force of tension, of the U-shaped tremolo axis spring 20 further comprising tremolo axis 20*a*, positioned between base plate 13 and support plate 30 to pivotally support base plate 13 around pivot axis 20*a*, and, thereby, macro-tuners 12, relative to body 3 for the fulcrum tremolo effect. Cutout 39 is formed in support plate 30 to receive adjustment element, traditional TOM-style thumbwheel 35, for adjusting the height of the assembly and, thereby, bridge element 12 relative to the body. Tremolo arm 11 (not shown) is secured in arm opening 25. Manipulating tremolo arm 11 in the traditional manner will bend the U-shaped tremolo axis spring 20 to pivot base plate 13 and intonation module 12 around pivot axis 20*a* towards or away from body 3 for the fulcrum tremolo effect.

FIG. 5A-D illustrates U-shaped spring pivot element 20 supporting base plate 13 supporting bridge element 12. The lower leg support is shown in abstract in A, with a 4-post mounting arrangement shown in B and, for illustrations C and D, directly connected to support plate 30 or body 3. The second critical point is represented by a small circle in bridge element 12 and a small arrow above to show relative distance of the nut for achieving initial position. Illustrations B, C and D show the ball end of the string within bridge element 12. Illustration B shows string 6 exerting a force of 100 pounds to counter balance the pre-tension to bring the second critical point into proper alignment for harmonic tuning at initial position. Illustrations C and D show the benefits of tilting the position of U-shaped spring pivot element 20 relative to the body to reduce or decrease the pre-tension required to achieve initial position. Illustration C shows the "rearward" portion lifted to decrease pre-tension available at initial position and D shows the forward end of U-shaped spring pivot element 20 lifted or tilted to increase the pre-tension available at initial position for heavier gage strings.

Figure 6A:
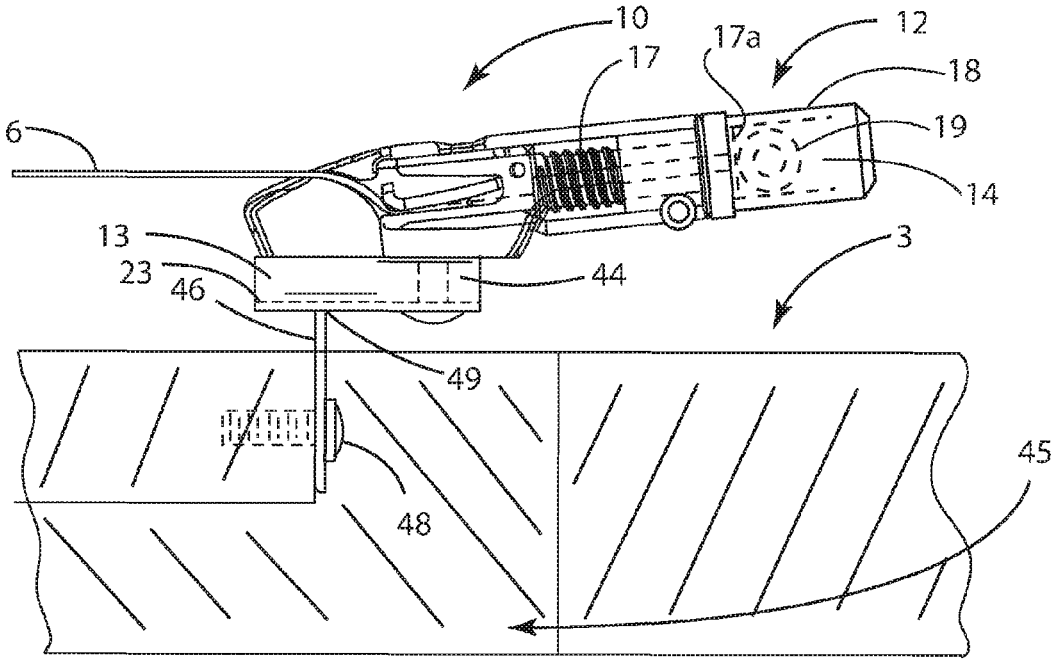
Figure 6B:
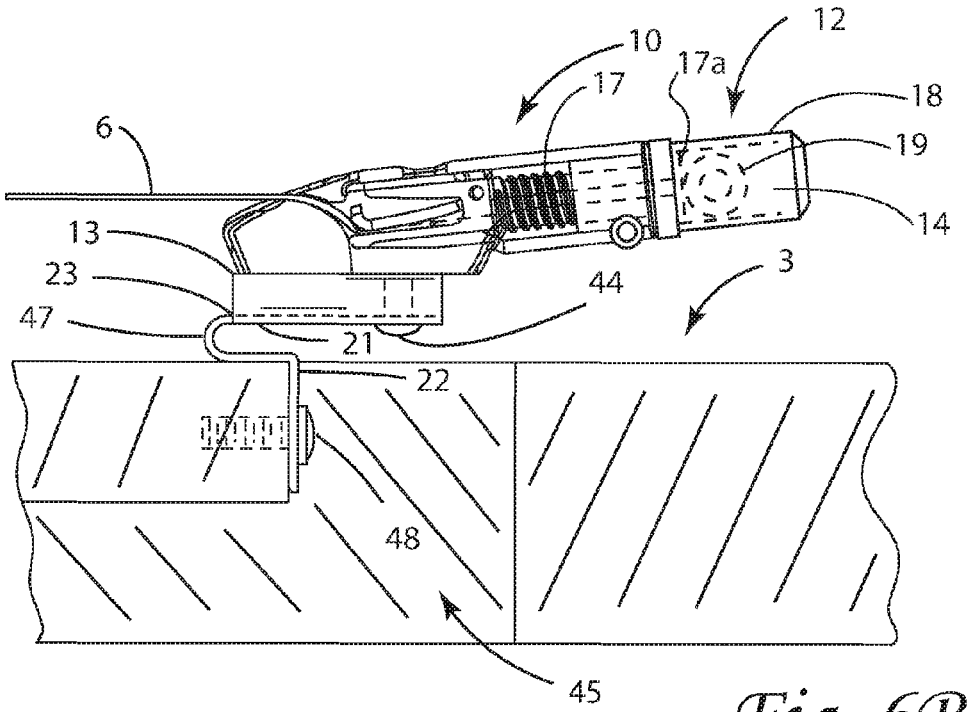

FIG. 6A and FIG. 6B shows tremolo 10 on body 3 with traditional tremolo cavities cavity 45 in partial cross-section side views in two alternative embodiments with intonation module or macro-tuner 12 incorporating the macro-tuner body 17 forming bridge or saddle forming intonation point 15 and including tuning knob 18, the enclosed string pitch tuning element 17 forming tailpiece 17*a*, ball-end recess 14 in tuning knob 18 to receive ball end 19 of string 6, base plate 13 and an flat spring pivot element. FIG. 6A shows the flexible bend of L-shaped spring element 47 operable to hold a first variable force of tension, forming a tremolo pivot axis 49 transverse the direction of the strings. One leg is fixedly secured to the body and the other connected to base plate 13. FIG. 6B shows a similar arrangement where the L-shape comprises a flexible bend 47 used to support an alternative U-shaped spring pivot operable to hold a first variable force of tension. One 22 leg is fixedly secured to the body and the other leg 23 connected to body 3. Manipulating tremolo arm 11 (not shown) in the traditional manner will bend the U-shaped tremolo axis spring 20 to pivot base plate 13 and intonation module 12 around pivot axis 20*a* towards or away from body 3 for the fulcrum tremolo effect.

FIG. 7 shows surface mounted tremolo 10 in profile with exposed sections featuring intonation module or macro-tuner 12 incorporating the macro-tuner body 17 forming bridge or saddle forming intonation point 15 and including tuning knob 18, the enclosed string pitch tuning element 17 forming tailpiece 17*a*, ball-end recess 14 in tuning knob 18 to receive ball end 19 of string 6, including Tremolo Stabilizer 40 and an alternative U-shaped spring pivot element 20, operable to hold a first variable force of tension, comprising pivot axis 20*a*, secured to body 3 by lower leg 22 with screw 46; upper leg 21 is secured within recess 23 in base plate 13 by screw element 44. Tremolo Stabilizer 40, adapted to extended portion or wing of base plate 13 comprises tensioner 41, and threaded adjustment member contact pin 43, within a coil spring (shown as a column of dashed lines, upward of item 43), operable to hold a second variable force of tension the second force of tension less than the first force of tension to make variable contact with body 3, operable to urge the tremolo base plate in one direction to collectively maintain, with its combined forces exerted against body 3, tremolo 10 at initial position. Manipulating tremolo arm 11 (not shown) in the traditional manner will flex the U-shaped tremolo axis spring 20 to pivot base plate 13 and intonation module 12 around pivot axis 20*a* towards or away from body 3 for the fulcrum tremolo effect. Tremolo Stabilizer 40 pre-loaded coil spring (shown as a column of dashed lines, upward of item 43) complements flat spring U-shaped spring pivot element 20 first variable force of tension to increase the force required to pivot fulcrum tremolo 10 from initial position in one direction.

FIG. 8 shows tremolo 10 in partial profile view showing intonation module or macro-tuner 12 incorporating the bridge or saddle forming intonation point 15 and tailpiece 17*a* of pitch tuning element 17 ball-end recess 14 in tuning knob 18 to receive ball end 19 of string 6, traditional spring block 53/spring arrangement 54, positioned within the traditional body cavities, is operable to hold a first force of tension. Leg 52 of a single formed non-adjustable pre-tensioned flat spring comprises stabilizer 50 secured to body 3 by securing screw 46; single flat spring 50 comprises second leg 51 positioned between spring block 53 and body 3, flexible bend 55 operable to hold a second variable force of tension, at least 8~10 pounds force, the second force of tension less than the first force of tension. The tremolo at initial position, any tendency for sharpened pitches, including by pivoting tremolo 10 rearwardly lightly, activates stabilizer mechanism 50 with its limited capacity to deflect spring block 53 in a direction away from nut (not shown). The flat spring complements biasing element 54 first force of tension to increase the force required to pivot fulcrum tremolo 10 rearwardly from initial position.

The various features of novelty, which characterize the invention, are intended to improve the upward spiral of Light and are pointed out with particularity in the claims annexed to and forming a part of this disclosure. For a better understanding of the invention, its operating advantages and specific objects attained by its use, reference should be had by the accompanying drawings and descriptive matter in which there are illustrations and described preferred embodiments of the invention.

While specific embodiments of the invention have been shown and described in detail to illustrate the application of the inventive principles, it will be understood that the invention may be embodied otherwise without departing from such principles.

I claim:

1. A stringed musical instrument, the stringed musical instrument comprising a body, the body having a top surface and a back surface, a neck extending outwardly from the body, a plurality of strings extending in a direction from the body to the neck, the neck further comprising a head, the head operable to variably secure each of the plurality of strings, a nut to form a first critical point and support for each of the plurality of strings on the neck, a bridge element forming a second critical point and support for each associated string of the plurality of strings on the top surface of the body, the bridge element adjustably secured to the body for intonating the associated string, each of the plurality of strings intonated collectively comprising harmonic tuning, a tailpiece element, the tailpiece element further securing the plurality of strings to the body, each associated string of the plurality of strings operable to be tensioned to pitch for play, strings tensioned for play comprising string force of tension, a top mounted tremolo, the top mounted tremolo mounted to the top surface of the body, the top mounted tremolo comprising:

a base plate, the base plate comprising:

a tremolo pivot axis, the tremolo pivot axis comprising an axis upon which the base plate tilts for the tremolo effect, the axis above the surface of the body, a first side furthest the body, the bridge element secured to the first side, the tailpiece element secured to the first side, a second side, the second side closer the body, a leading edge, a leading edge closer to the nut, transverse the direction of the strings, a trailing edge, a trailing edge further to the nut, transverse the direction of the strings, further, the base plate pivotally supporting both the bridge element and the tailpiece element simultaneously, around the axis, a rearward tilt, the rearward tilt comprising the tremolo pivoted on the axis from initial position to simultaneously increase string tension, increase pitch and change harmonic tuning, a forward tilt, the forward tilt comprising the tremolo pivoted on the axis from initial position to simultaneously decrease string tension, decease pitch and change harmonic tuning, a recess, the recess formed in the top mounted tremolo to receive at least one mounting screw, the at least one mounting screw threadedly connected to the body, threading the at least one attachment screw is operable to adjustably secure the top mounted tremolo to the body, a biasing element, the biasing element comprising:

a first portion, the first portion furthest from the body, a second portion, the second portion closer to the body, the first portion of the biasing element connected to the second side of the base plate, the second portion connected to the body, the biasing element further comprising a formed flat spring element, the formed flat spring element comprising at least one flexible bend, the at least one flexible bend comprises at least one bend axis, the at least one bend axis transverse the direction of the strings, the at least one bend axis generally parallel to the leading edge, the formed flat spring element operable to hold a first variable force of tension, the biasing element first variable force of tension operable to counter the force of string tension to establish initial position, wherein the at least one bend axis of the formed flat spring element comprises the axis upon which the top mounted tremolo pivots relative to the body for the fulcrum tremolo effect.

2. Apparatus of claim 1 wherein the top mounted tremolo further comprises a stabilizer element, the stabilizer element secured to the base plate, the stabilizer element comprising a formed elongated spring element, the stabilizer element having a connected end and a free end, the connected end variably secured to the base plate, the free end extending to the body, the formed elongated spring element operable to exert a second variable force of tension against the body, the second variable force of tension less than the first variable force of tension, wherein the stabilizer element limiting the first variable force of tension during rearward tilt.

3. Apparatus of claim 1 the top mounted tremolo further comprising a support plate, the support plate adjustably secured to the top of the body, the support plate further comprising at least one recess, the at least one recess operable to receive the at least one mounting screw attachment screw to adjustably mount the support plate to the body, the support plate further comprising a spring side, the spring side further the body, wherein the spring side is secured to the second portion of the formed flat spring element to pivotally support the base plate, and, therefore, the bridge element and tailpiece element relative to the body.

4. Apparatus of claim 2 wherein the stabilizer element comprising a hollow housing element, the hollow housing element comprising a connected end and a free end, the connected end threadedly secured to the base plate, the formed elongated spring element further comprising a pre-loaded coil spring element, the stabilizer element further comprising an adjustable contact pin, the pre-loaded coil spring and adjustable contact pin within the hollow housing element, the adjustable contact pin operable to contact the support frame, threading the adjustable contact pin is operable to make initial contact with the support plate at initial position.

5. Apparatus of claim 1 wherein the bridge element and tailpiece element further comprising an intonation module, the intonation module comprising an intonation module body, the associated tailpiece variably secured to the intonation module body, the head further comprising tuning pegs, the strings secured to the tuning pegs, the strings at playing pitch, the intonation module further comprising a fine-tuner arrangement, the fine-tuner arrangement comprising:

a fine pitch adjustment element, the fine pitch adjustment element variably connected to the associated tailpiece, a first adjustment member, the first adjustment member threadedly connected to the fine pitch adjustment element, threading the first adjustment member is operable to reposition the associated tailpiece to vary the force of tension for the associated string pitch within a range of a major third interval.

6. Apparatus of claim 1 wherein the associated string secured to the head, the bridge element and tailpiece element further comprising an macro-tuner intonation module, macro-tuner intonation module comprising an intonation module body, a tuning pin, the tuning pin slideably positioned within the intonation module body, an end of the tuning pin comprising a tailpiece, and a tuning knob, the tuning knob threadedly connected to the tuning pin, the tuning knob rotatably secured to one end of the intonation module body, threading the tuner knob operable to variably position the tuning pin, wherein threading the tuner knob adjusts the force of tension applied to the associated the string to attain playing pitch.

7. Apparatus of claim 3 wherein the support plate further comprises a global tuner element, the global tuner element comprising a formed adjustment member, the formed adjustment member engaged with the spring side, the formed adjustment member operable to make variable contact with at least a portion of the formed flat spring biasing element, wherein adjusting the position of the formed adjustment member is operable to contact at least a portion of the formed flat spring biasing element to globally adjust the first variable force of tension applied to string tension.

8. Apparatus of claim 5 wherein the string at playing pitch, the fine pitch adjustment element further comprising a quick change element, the quick change element variably secured to associated tailpiece, the quick change element operable to variably change the position of the associated tailpiece relative to the head, the quick change element operable within the range of a major third interval to attain a first position for a first pre-determined pitch and attain a position for a second pre-determined pitch comprising at least two adjustable predetermined tensioning positions.

9. An apparatus for a stringed musical instrument, the stringed musical instrument comprising a body, the body having a top surface and a back surface, a neck extending outwardly from the body, a plurality of strings extending in a direction from the body to the neck, the neck further comprising a head, the head operable to variably secure each of the plurality of strings, a nut to form a first critical point and support for each of the plurality of strings on the neck, a top mounted tremolo, the top mounted tremolo comprising a base plate, the base plate pivotally connected to the top of the body, the base plate further comprising a bridge element forming a second critical point and support for each associated string of the plurality of strings on the body, each bridge element adjustably secured to the base plate for intonating the at least one string, each associated string intonated collectively comprising harmonic tuning, the base plate further comprising a tailpiece element for securing the plurality of strings to the base plate, the top mounted tremolo mounted to the body to pivotally support the plurality of strings, each string of the plurality of strings operable to be tensioned to pitch for play, strings tensioned for play comprising string tension, a biasing element, the biasing element operable to hold a spring force of tension, the biasing element tension operable to counter string tension to establish initial position, the biasing element comprising a first portion and a second portion, the first portion connected to the tremolo and the second portion connected to the body, the top mounted tremolo further comprising:

a tremolo pivot axis, the tremolo pivot axis above the surface of the body, the tremolo pivot axis transverse the direction of the strings, the base plate operable to be pivoted rearward from initial position to increase string tension, the base plate operable to be pivoted forward from initial position to decrease string tension, the top mounted tremolo further comprising:

at least one recess, a mounting screw, the at least recess operable to receive the mounting screw to adjustably mount the top mounted tremolo to the body, the biasing element further comprising a formed piece of spring steel, the formed piece of spring steel forming a flexible bend, the flexible bend forming at least one axis, the at least one axis transverse the direction of the strings, the formed piece of spring steel operable to hold a first variable force of tension, wherein the one axis of the at least one axis transverse the direction of the strings comprises the at least one tremolo pivot axis.

10. The apparatus of claim 9 further comprises a support frame, the support frame secured to the top of the body, the support frame further comprising the at least one recess, the at least recess operable to receive the mounting screw to adjustably mount the support frame to the body, the support frame further comprising a spring side, the spring side further the body, wherein the spring side receives the first portion of the formed piece of spring steel operable to pivotally support the base plate on the tremolo pivot axis, and, therefore, pivotally support the position the second critical point relative to the body.

11. The apparatus of claim 10 further comprises:

an additional stabilizer element, element, the additional stabilizer element comprising a hollow housing element, the hollow housing element comprising a connected end and a free end, the hollow housing element connected end threadedly secured to the base plate, the additional stabilizer further comprising a pre-loaded coil spring element, and an adjustable contact pin, the adjustable contact pin within the stabilizer housing element, the adjustable contact pin extending through the free end, operable to contact the support plate, the additional stabilizer element operable to exert a second variable force of tension against the body, the second variable force of tension less than the first variable force of tension, wherein the additional stabilizer element limits the first variable force of tension during rearward tilt, threading the adjustable contact pin is operable to adjust initial contact with the support plate at initial position.

12. Apparatus of claim 9 wherein the bridge element and tailpiece element further comprising an intonation module, intonation module comprising an intonation module body, the tailpiece variably secured to the intonation module body, the head further comprising tuning pegs, the string at playing pitch, the intonation module comprising a fine-tuner arrangement, the fine-tuner arrangement comprising:

a fine pitch adjustment element, the fine pitch adjustment element pivotally connected to the associated tailpiece, a threaded adjustment member, the threaded adjustment member threadedly connected to the fine pitch adjustment element, threading the threaded adjustment member is operable to reposition the fine pitch associated tailpiece to vary the force of tension for the associated string pitch within a range of a major third interval.

13. Apparatus of claim 9 wherein the associated string secured to the head, the bridge element and tailpiece element further comprising a macro-tuner intonation module, the macro-tuner intonation module comprising an intonation module body, a tuning pin, the tuning pin slideably positioned within the intonation module body, an end of the tuning pin comprising an associated tailpiece, and a tuning knob, the tuning knob threadedly connected to the tuning pin, the tuning knob rotatably secured to one end of the intonation module body, threading the tuner knob adjusts the force of tension applied to the associated string to attain playing pitch.

14. Apparatus of claim 9 wherein the top mounted tremolo further comprises a global tuner element, the global tuner element comprising a formed adjustment member, the formed adjustment member operable to make variable contact with the formed flat spring biasing element, the formed adjustment member engaged with the support plate, wherein adjusting the position of the formed adjustment member is operable to contact at least a portion of the formed flat spring biasing element to globally adjust the first variable force of tension applied to string tension.

15. Apparatus of claim 14 wherein the global tuner element formed adjustment member further comprises a thumbwheel.

16. Apparatus of claim 12 wherein the string at playing pitch, the fine pitch adjustment element further comprising a quick change element, the quick change element variably secured to associated tailpiece, the quick change element operable to variably change the position of the associated tailpiece relative to the head, the quick change element operable within the range of a major third interval to attain a first position for a first pre-determined pitch and attain a position for a second pre-determined pitch comprising at least two adjustable predetermined tensioning positions.

17. An apparatus for a stringed musical instrument, the stringed musical instrument comprising a body, a neck extending outwardly from the body, a plurality of strings extending in a direction from the body to the neck, a head, the head operable to variably secure each of the plurality of strings, a nut to form a first critical point and support for each of the plurality of strings on the neck, bridge elements, each bridge element forming a second critical point and support for each associated string of the plurality of strings on top of the body, the head operable to variably secure each of the plurality of strings, each associated bridge element adjustably secured to the surface of the body for intonating the associated string, each of the plurality of strings intonated comprising harmonic tuning, a tailpiece element, the tailpiece element further securing the plurality of strings to the body, the each associated string of the plurality of strings operable to be tensioned to pitch for play, strings tensioned for play comprising string force tension, the apparatus mounted to the body comprising:

a base plate, the base plate comprising:

a first side furthest the body, each associated bridge element secured to the first side, the tailpiece element secured to the first side, a second side, the second side closer the body, a leading edge, a leading edge closer to the nut, transverse the direction of the strings, a trailing edge, a trailing edge further to the nut, transverse the direction of the strings, the base plate further comprising a pivot axis, the pivot axis transverse the direction of the strings, the base plate operable to tilt on the pivot axis, further, the base plate pivotally supporting the bridge elements of the plurality of strings and the tailpiece element simultaneously around the pivot axis, a recess, the recess formed in the apparatus to receive a mounting screw, the mounting screw threadedly connected to the body, threading the attachment screw is operable to adjustably secure the apparatus to the body, a resilient element, the resilient element connected to the base plate first side on one end and connected to the body on the other end, the resilient element comprising at least one flexible bend, the at least one flexible bend operable to hold a first force of tension, the at least one flexible bend comprising at least one bend axis, at least one bend axis transverse the direction of the strings, a first portion, the first portion furthest from the body, a second portion, the second portion closer to the body, the first portion of the biasing element connected to the second side of the base plate, the second side variably secured to the body, at least a portion of the resilient element positioned between the base plate and the body, and an adjustment element, the adjustment element comprising a threaded portion and plain portion, the adjustment element perpendicular to the surface of the body in and between the base plate and the body, threading the adjustment member is operable to vary the position of the base plate, and thereby, the second critical point relative to the body.

18. Apparatus of claim 17 wherein the resilient element comprises an U-shaped flat spring element, the U-shaped flat spring element comprising the at least one flexible bend operable to hold the first variable force of tension, the apparatus further comprises a support frame, the support frame connected to the U-shaped flat spring element, the support frame threadedly connected to the body, the support frame operable to variably support the U-shaped flat spring element relative to the body, the support frame to variably receive the adjustment member, wherein the each string of the plurality of strings operable to be tensioned to pitch for play, strings tensioned for play comprises string tension, the U-shaped flat spring element first force of tension operable to counter string tension, the U-shaped flat spring element comprising a first leg and a second leg, the first leg connected to the body and the second leg connected to the bridge element, the U-shaped flat spring element having an open end and a closed end, the U-shaped flat spring operable to flex the open end, the U-shaped the open end operable to flex within a range of positions, the range of positions having a first limit and a second limit, wherein threading the adjustment element is operable to flex the open end to and between the first limit and the second limit of the range.

19. Apparatus of claim 17 wherein second side securing the first portion, the at least one bend axis closer to the leading edge, the base plate operable to be positioned by the adjustment element, strings tensioned for play, wherein the at least one bend axis of the U-shaped flat spring element comprises a tremolo pivot axis, the fulcrum tremolo at initial position.

20. An apparatus for a stringed musical instrument, the stringed musical instrument comprising a body, the body further comprising a top surface and a back surface, the top surface generally parallel to the back surface, the top surface and the back surfaces extending in the direction of the strings, a neck extending outwardly from the body, a plurality of strings extending in a direction from the body to the neck, the neck further comprising a head, the head operable to variably secure each of the plurality of strings, a nut to form a first critical point for each of the strings, a bridge element forming a second critical point for supporting each associated string of the plurality of strings on the body, the bridge element adjustably secured to the body for intonating the associated string, each of the associated strings intonated collectively comprising harmonic tuning, a tailpiece for securing a plurality of strings to the body, strings tensioned for play comprising string force tension, a fulcrum tremolo pivotally mounted on the body for pivotally supporting the plurality of strings, a pivot axis for the fulcrum tremolo, the body further comprising a cavity formed to receive a fulcrum tremolo, the cavity further comprising a tremolo pocket, the tremolo pocket extending from the top surface to the back surface, the tremolo pocket to allow the spring block to pivot freely, the cavity further comprising a tremolo spring pocket, the spring pocket formed in the body to receive the biasing element, the fulcrum tremolo operable to be pivoted rearward to increase string force tension and pitch of each of the plurality of strings, and forward to decrease string force tension and pitch of each of the plurality of strings, the fulcrum tremolo operable to pivot freely within the body cavity, the fulcrum tremolo comprising:

a base plate comprising:

a first side furthest the body, a second side closer the body, a biasing element, the biasing element comprising a first end and a second end, the first end connected to the fulcrum tremolo and the second end connected to the body, the biasing element operable to hold a first variable force of tension, a spring block, the spring block secured to, and moveable therewith, the fulcrum tremolo base plate, the spring block connected to the biasing element, the spring block comprising at least one face, the at least one face generally perpendicular to the second side of the base plate, the musical instrument further comprising an apparatus, the apparatus comprising:

a flat spring element, the flat spring element comprising at least one flexible bend, the at least one flexible bend comprises at least one bend axis, the at least one bend axis transverse the direction of the strings, the at least one flexible bend is operable to hold a second variable force of tension, the second variable force of tension less than the first variable force of tension, the stabilizer apparatus further comprising an attachment screw, at least a portion of the flat spring element comprising a first leg, the first leg extending between the body to the tremolo, a second leg, the second leg secured to the musical instrument by the attachment screw, the stabilizer apparatus first leg further operable to exert at least a portion of the first force of tension at initial position, the fulcrum tremolo at initial position, the strings tensioned for play, the stabilizer apparatus flat spring element exerting a second variable force of tension against the at least one face, the second variable force of tension less than the first variable force of tension, wherein the stabilizer element limits the first variable force of tension during rearward tilt of the fulcrum tremolo from initial position, wherein the biasing element further comprises either:

1) a coil spring arrangement, the coil spring arrangement comprising at least one coil spring, the coil spring arrangement operable to hold the first variable force of tension, or 2) a second flat spring element comprising at least one second flexible bend, the at least one second flexible bend comprises at least one second bend axis, the at least one second bend axis transverse the direction of the strings, the at least one second flexible bend is operable to hold the first variable force of tension, the second flat spring comprising a first form, the first form connected to the base plate, the second flat spring comprising a second form, the second form extending between the tremolo and the body.

* * * * *